US005406773A

United States Patent [19]

Limousin

[11] Patent Number: 5,406,773

[45] **Date of Patent: * Apr. 18, 1995**

[54] SELF THREADER FOR WRAPPING MACHINE

[76] Inventor: Jean L. Limousin, 1755 Gracelyn Dr., Clearwater, Fla. 34616

[ * ] Notice: The portion of the term of this patent subsequent to Jan. 4, 2011 has been disclaimed.

[21] Appl. No.: 147,722

[22] Filed: Nov. 4, 1993

Related U.S. Application Data

[63] Continuation-in-part of Ser. No. 973,053, Nov. 6, 1992, Pat. No. 5,274,985.

[51] Int. Cl.[6] ..... B65B 9/22; B65B 41/12

[52] U.S. Cl. ..... 53/550; 53/389.2; 493/302

[58] Field of Search ..... 53/450, 550, 551, 552, 53/389.2; 493/302

[56] References Cited

U.S. PATENT DOCUMENTS

| | | | |
|---|---|---|---|
| 3,431,831 | 3/1969 | McGill et al. | 53/550 X |
| 3,748,822 | 7/1973 | Borgardt | 53/550 |
| 4,419,855 | 12/1983 | Shanklin | 53/550 X |
| 4,517,789 | 5/1985 | Ash | 53/551 X |
| 4,576,588 | 3/1986 | Umeda et al. | 53/551 X |
| 4,658,569 | 4/1987 | Hanagata | 53/389.2 X |
| 4,945,709 | 8/1990 | Cerf | 53/550 X |

*Primary Examiner*—Horace M. Culver
*Attorney, Agent, or Firm*—Frijouf, Rust & Pyle

[57] ABSTRACT

A self threader is disclosed for a wrapping machine having a tube former including tube former wall means terminating in a first tube former plate and a second tube former plate. The tube former is adapted to receive a first edge of a wrapping sheet between the first tube former plate and the second tube former plate and is adapted to receive a second edge of the wrapping sheet above the second tube former plate with the first and second edges and overlapping for forming the wrapping sheet into a tube to receive a product therein. The self threader comprises a guide plate located proximate to the second tube former plate and extending beyond the first tube former plate for directing a first edge of the wrapping sheet between the first tube former plate and the second tube former plate.

23 Claims, 27 Drawing Sheets

40
41
43
43A
51
51A
61

40
41
51C
51
51B
51A
61A
61
43A
62
42
43
64
52C
52
52B
52A
62A 43
43A
52
52A
62
40
42
61

40
41
51B
51A
61A
61
61B
43A
52C
51C
52A
52B
42
62A
62
62B 12E
12E 19D
19D 20D
20D

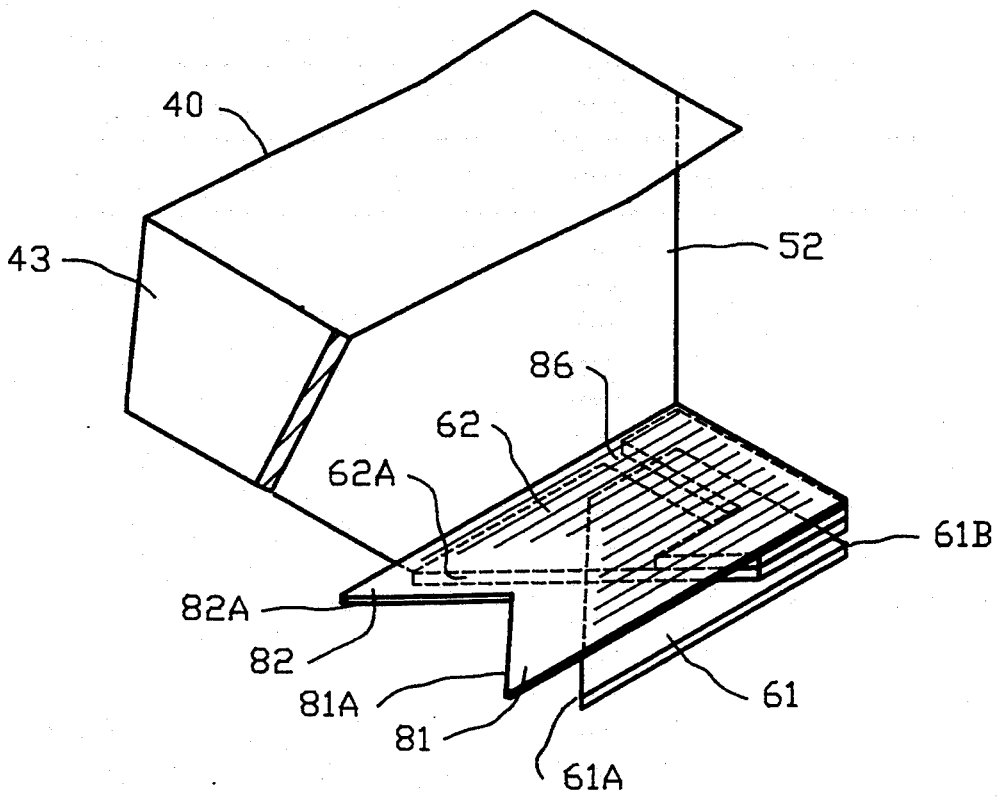
FIG. 23
FIG. 24
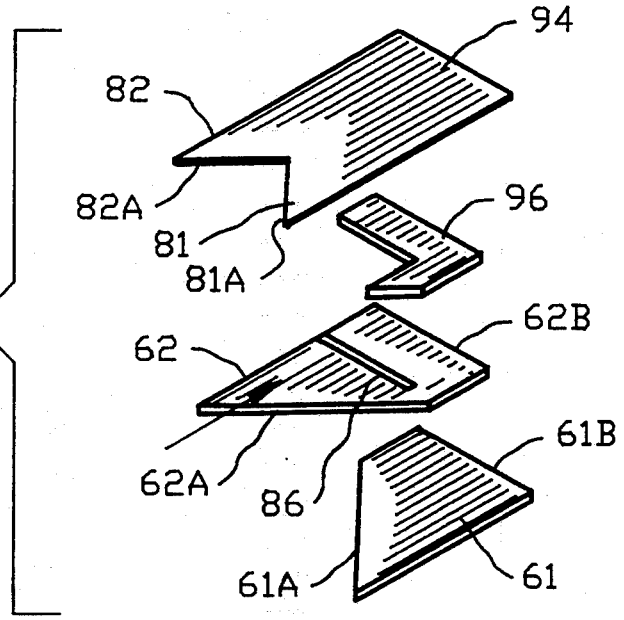

40
41
141
51
51A
43
43A 51C
51B
91
61A
61
121
112
111
130
122
42
142
64
52C
52
52B
52A
92
81A
81
82A
82
62A
62
86

40
41
141
36A
51
51A
43
43A 41
141
51C
51
51B
51A
91
61A
61
43A
36
121
111
130
122
112
40
43
42
36B
142
64
52C
52
52B
52A
92
43
43A
36
36B
40
142
42

40
51A
36
51
51B
36A
81A
81
141
61A
61
43A
52C
51C
52A
52
52B
36B
82A
82
142
62A
62
86

27D
27D 28D
28D

SELF THREADER FOR WRAPPING MACHINE

CROSS-REFERENCE TO RELATED APPLICATIONS

This is a continuation-in-part of U.S. patent application Ser. No. 07/973,053 filed Nov. 6, 1992, now U.S. Pat. No. 5,274,985. All subject matter set forth in application Ser. No. 07/973,053 is hereby incorporated by reference into the present application as if fully set forth herein.

BACKGROUND OF THE INVENTION

1. Field of the Invention

This invention relates to packaging utilizing a wrapping machine wherein a wrapping sheet is formed into a tube for wrapping product therein and more particularly to a self threader for the wrapping sheet.

2. Background of the Invention

Over the past several decades, various types of wrapping machines have been developed for wrapping products articles. One type of wrapping machines includes shrink wrap packing machines. Shrink wrap packaging has become widely used to provide a low cost packaging technique for a wide assortment of articles. Typically, the article or articles are incased within a wrapping sheet and is passed through a heating oven whereby the wrapping sheet incases the article or articles by the contraction of the wrapping sheet. Although, the use of shrink wrapping techniques is simple in theory, the physical wrapping of the article or articles by the wrapping sheet encounters some difficulties depending on the shape and number of articles to be encased within the wrapping sheet. Since the typical shrink wrap packaging machine operates at high speed, the handling of the wrapping sheet presents a complex engineering problem for the shrink wrapping packaging machine. In addition, any defective wrap and/or tearing of the wrapping sheet will produce defective packages thereby requiring the wrapping process to be terminated and requiring the wrapping sheet to be rethreaded and/or adjusted within the wrapping machine. Such a termination of the wrapping process is significantly costly as well as requiring an operator to readjust and/or re-thread the wrapping sheet within the machine. Typically, the wrapping sheet is disposed proximate to a heating oven thereby increasing the danger of burning or the like by the operator.

One specific type of shrink wrapping machine incorporates a tube former commonly referred to as a forming shoe for forming a wrapping sheet of heat shrinkable material into a longitudinally extending tube. The tube is sealed on terminating end and by a seal bar with a first and second edge of the wrapping sheet being in an overlapping relationship and secured to one another by electrostatic adhesive or welding means. The forming tool includes a first forming plate and a second forming plate for forming the wrapping sheet within the tube with the first and second edges disposed in the overlapping relationship.

Although the use of a first and second forming plate has provided a suitable means for forming the longitudinal extending tube of the wrapping sheet, this prior art tube former has certain disadvantages. Firstly, the wrapping sheet must be hand threaded between the first and second forming plates by an operator. Secondly, the prior art forming tools lack any positive means for maintaining the position of the first edge of the wrapping sheet between the first and second forming plates. The tension of the sheet was relied on to maintain the position of the first edge of the wrapping sheet within the first and second forming tool plates.

My prior invention set forth in United States Patent application Ser. No. 07/973,053 filed Nov. 6, 1992 disclosed a novel self threader for a wrapping machine for self threading a wrapping sheet within a tube former. In addition, this invention provided a positive means for maintaining the position of the wrapping sheet within the tube former. The invention was both simple and effective without appreciably raising the cost of the wrapping machine and was easily adapted to existing wrapping machines.

It is an object of the present invention to provide an alternate structure for novel self threader for a wrapping machine for self threading a wrapping sheet within a tube former.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an improved method and apparatus for a self threader for a wrapping machine. The wrapping machine has a tube former including tube former wall means terminating in a first tube former plate and a second tube former plate. The tube former is adapted to receive a first edge of a wrapping sheet between the first tube former plate and the second tube former plate and adapted to receive a second edge of the wrapping sheet above the second tube former plate with the first edge of a wrapping sheet overlapping the second edge of the wrapping sheet for forming the wrapping sheet into a tube to receive a product therein. The improvement comprises a first guide plate located proximate to the second tube former plate and extending beyond the first tube former plate for directing the first edge of the wrapping sheet between the first tube former plate and the second tube former plate.

In a more specific embodiment of the invention, the first tube former plate is disposed in a parallel and spaced apart relationship relative to the second tube former plate. The first guide plate is integrally formed with the second tube former plate and extends adjacent to the first lower tube former wall. The tube former wall means of the tube former includes a first and a second upper tube former wall respectively connected to a first and a second lower tube former wall with the first and second tube former plates being secured substantially perpendicular to the first and second lower tube former walls, respectively. The first and second lower tube former walls have first and second forward edges being angularly orientated for directing the first and second edges of the wrapping sheet toward the first and second tube former plates. A first and a second tube rail may be secured proximate to the junction of the first and second lower tube former walls with the first and second upper tube former walls, respectively for guiding the wrapping sheet.

Preferably, the first tube former plate is integrally formed with the first tube former wall and the second tube former plate being integrally formed with the second tube former wall with the first tube former plate being disposed substantially perpendicularly to the first tube former wall and with the second tube former plate being disposed substantially perpendicularly to the second tube former wall. A first leading edge of the first tube former plate forms an acute angle relative to the first lower tube former wall whereas a second leading edge of the second tube former plate forms an acute angle relative to the second lower tube former wall.

In another embodiment of the invention, a recess is defined in a central portion of the first and second tube former plates for enabling the wrapping sheet to rest on the first and second tube former plates proximate the recess with the second edge of the wrapping sheet overlapping the first edge of the wrapping sheet within the recess. A first guide plate is secured to the second tube former plate and extending beyond the first tube former plate for directing the first edge of the wrapping sheet between the first tube former plate and the second tube former plate. A second guide plate is secured to the second tube former plate and extending beyond the second tube former plate for directing the second edge of the wrapping sheet to overlap the first edge of the wrapping sheet within the recess.

In a further embodiment of the invention, a first guide plate is secured to the second tube former plate and extending beyond the first tube former plate for directing the first edge of the wrapping sheet between the first tube former plate and the second tube former plate. The second tube former plate includes a slot for receiving the second edge of the wrapping sheet therethrough for directing the second edge of the wrapping sheet into contact with the first edge of the wrapping sheet. A second guide plate is secured to the second tube former plate for cooperating with the slot and extending beyond the second tube former plate for directing the second edge of the wrapping sheet into the slot.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which:

FIG. 23 is an isometric view of a third embodiment of the self threading tube former of the present invention;

FIG. 24 is an exploded view of the self threader of FIG. 23;

Similar reference characters refer to similar parts throughout the several Figures of the drawings.

DETAILED DISCUSSION

Figure 1:
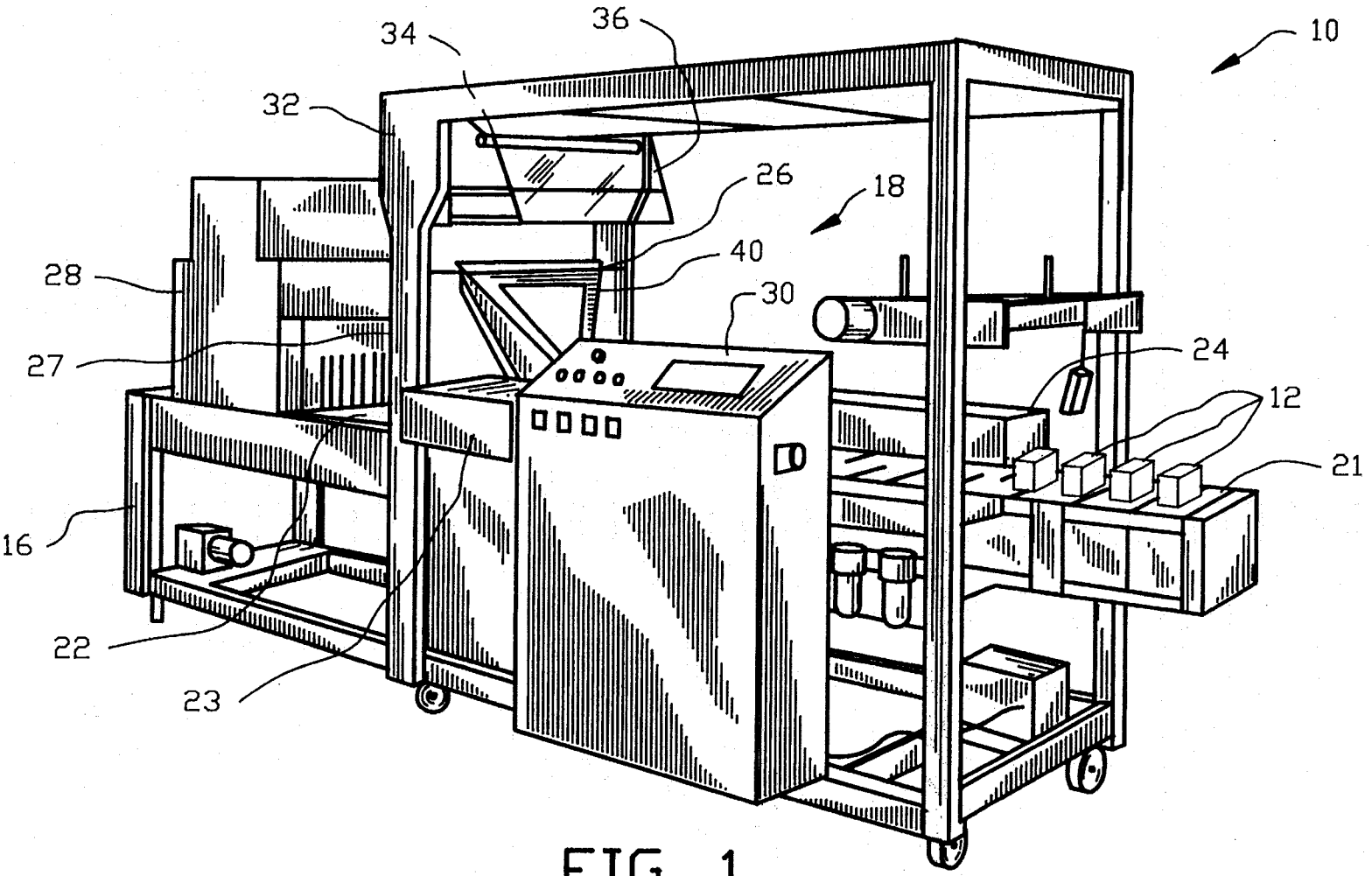
FIG. 1 is an isometric view of a wrapping machine for packing a package into a wrapped package.

FIG. 1 is an isometric and side views of a wrapping machine shown as a shrink wrapping machine 10 for packaging a package 12 such as a product into a wrapped package 14. Although the invention is shown with reference with a wrapping machine 10, it should be understood that the present invention can be incorporated into various types of wrapping machines and the like.

The wrapping machine 10 comprises a frame 16 for supporting a conveyor means 18 comprising a first and a second conveyor 21 and 22. A lateral pusher 23 and a longitudinal pusher 24 in concert with the first and second conveyors 21 and 22 convey the packages 12 through the wrapping machine 10. The wrapping machine 10 further comprises a wrapping station 26, a sealing station 27 and a heat shrink oven 28. A control 30 regulates the various operations of the wrapping machine 10 in a conventional manner.

The wrapping station 26 comprises a support 32 for supporting a reel 34 of wrapping sheet 36 for forming the wrapped package 14. The wrapping station 26 is of conventional design and may incorporate the various means for insuring the proper feed and tension on the wrapping sheet 36.

Figure 2:
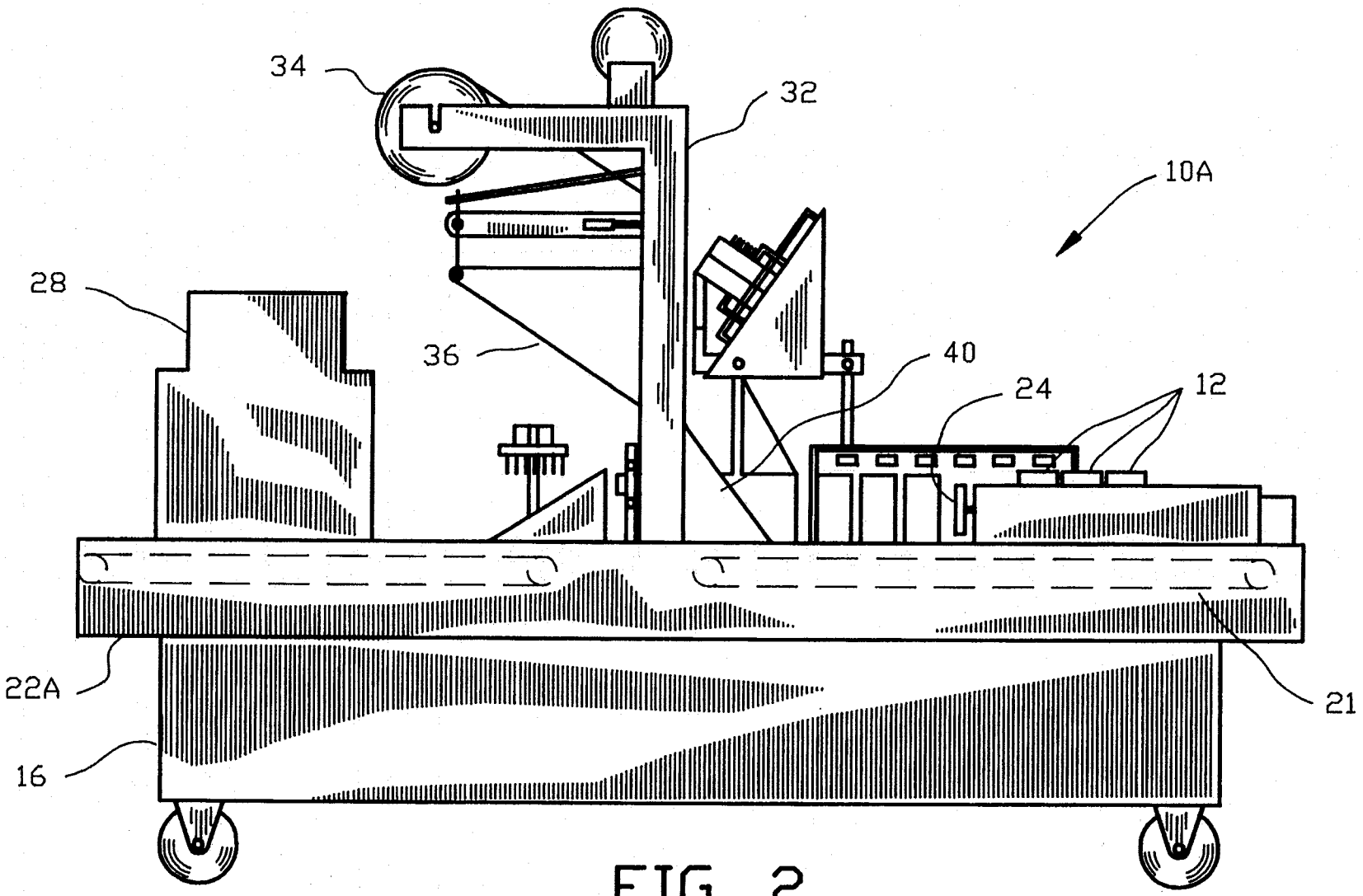
FIG. 2 is a side view of the wrapping machine of FIG. 1.

FIG. 2 illustrates side views of a second wrapping machine shown as a shrink wrapping machine 10A for packaging the package 12 into a wrapped package 14. In this shrink wrapping machine 10A, a second conveyor 22A is a vacuum belt conveyor 22A for holding the wrapping sheet 36 for drawing the packages 12 through the heat shrink oven 28 to form the wrapped package 14.

Figure 3:
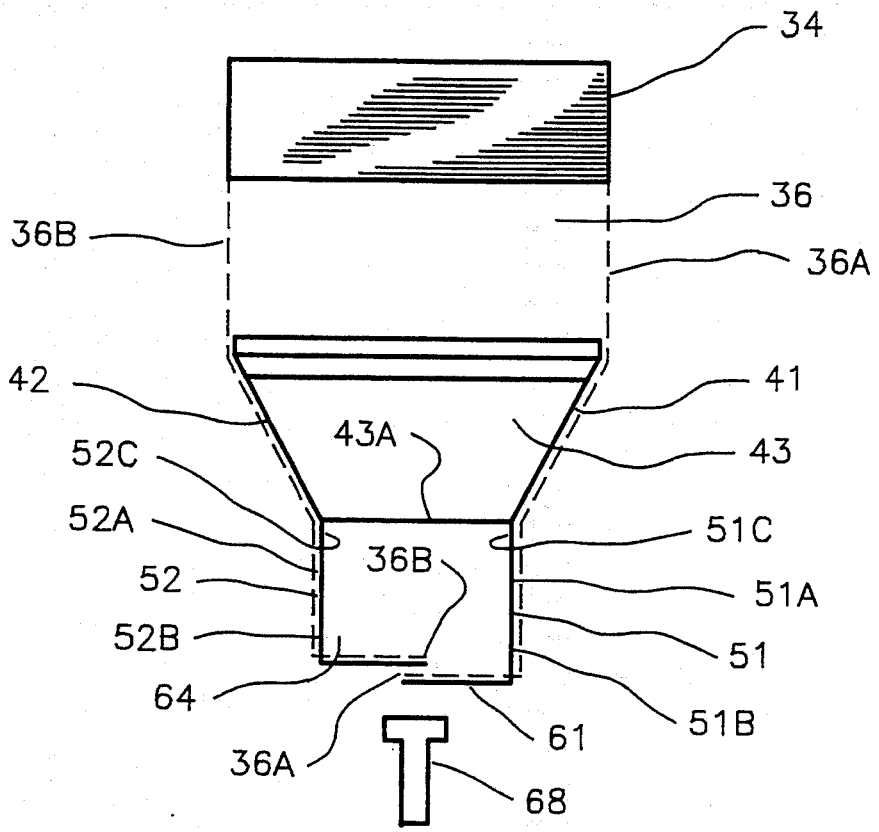
FIG. 3 is a front view of a tube former in the wrapping machine of FIG. 1.
Figure 4:
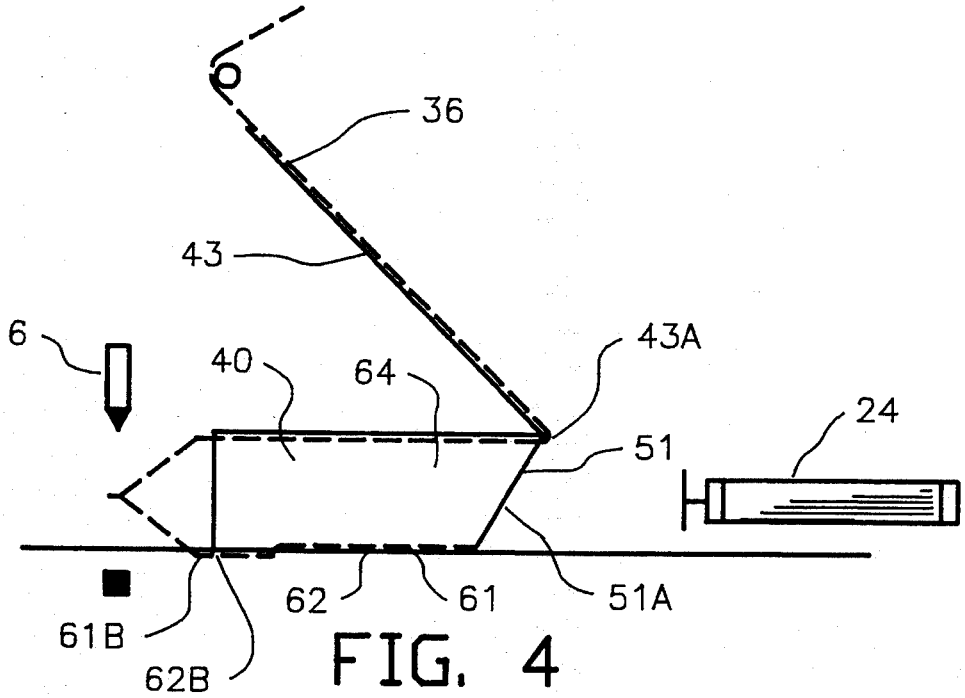
FIG. 4 is a side sectional view of the tube former of FIG. 3.
Figure 5:
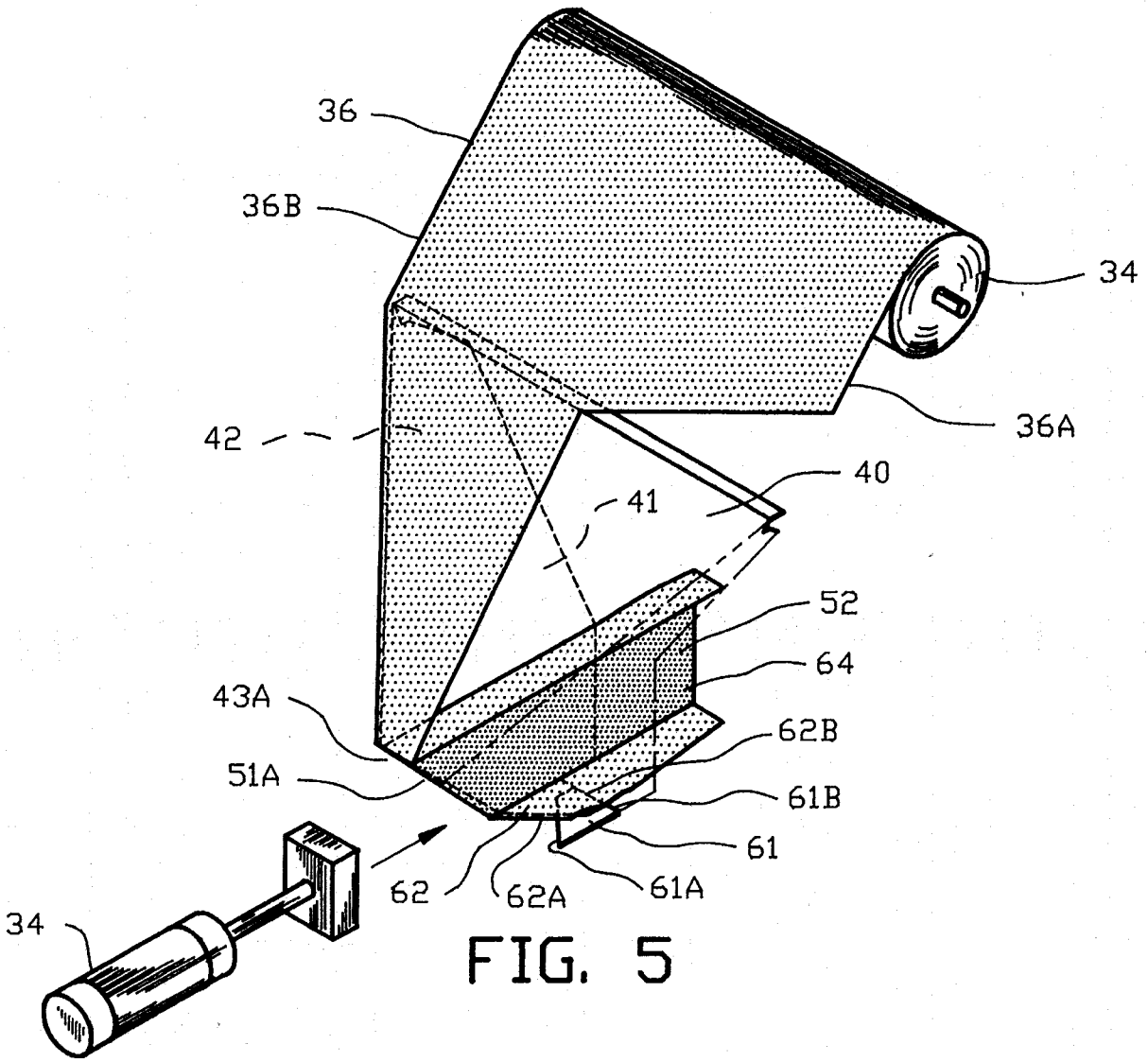
FIG. 5 is an isometric view of the tube former of FIGS. 3 and 4.

FIGS. 3–5 illustrate a convectional tube former 40 incorporated into the wrapping station 26 for forming the wrapping sheet 36 into a tube. The tube former 40 comprises a first and a second upper tube former wall 41 and 42 interconnected by an upper front wall 43. The first and second upper tube former walls 41 and 42 support a first and a second lower tube former wall 51 and 52 having front edges 51A and 52A. The upper front wall 43 defines a front edge 43A. The first lower tube former wall 51 defines an external surface 51B and internal surface 51C whereas the second lower tube former wall 52 defines an external surface 52B and internal surface 52C. A first and a second tube former plate 61 and 62 are respectively secured to the first and second lower tube former walls 51 and 52. The first tube former plate 61 is disposed in a parallel and spaced apart relationship relative to the second tube former plate 62. The first and second tube former plates 61 and 62 are disposed substantially perpendicular to the first and second lower tube former walls 51 and 52.

The first and second upper tube former walls 41 and 42 and the upper front wall 43 cooperate with the first and second lower tube former walls 51 and 52 for enabling the wrapping sheet 36 to enter into a forming tunnel 64 defined by the front edges 51A and 52A of the first and second lower tube former walls 51 and 52 and the front edge 43A of the upper front wall 43. The front edges 51A and 52A of the first and second lower tube former walls 51 and 52 are angled for directing the wrapping sheet 36 toward the first and second tube former plates 61 and 62.

FIG. 3 illustrates an electrostatic generator 68 disposed adjacent rear edges 61B and 62B of the first and second tube former plates 61 and 62 for securing the first edge 36A of the wrapping sheet 36 to the second edge 36B of the wrapping sheet 36. FIG. 4 illustrates a seal bar 69 for forming a seal 36A in the tube 66.

FIG. 5 illustrates the first and second tube former plates 61 and 62 having front edges 61A and 62A disposed in an angular relationship. The front edges 61A and 62A are angled for receiving a first edge 36A of the wrapping sheet 36 between the first and second tube former plates 61 and 62 and for receiving a second edge 36B of the wrapping sheet 36 above the second tube former plate 62. The first edge 36A of the wrapping sheet 36 overlaps the second edge 36B of the wrapping sheet 36 for forming the wrapping sheet 36 into the tube 66 to receive the package 12 within the tube 66. The electrostatic generator 68 disposed adjacent rear edges 61B and 62B of the first and second tube former plates 61 and 62 secure the first edge 36A of the wrapping sheet 36 to the second edge 36B of the wrapping sheet 36.

Figure 6:
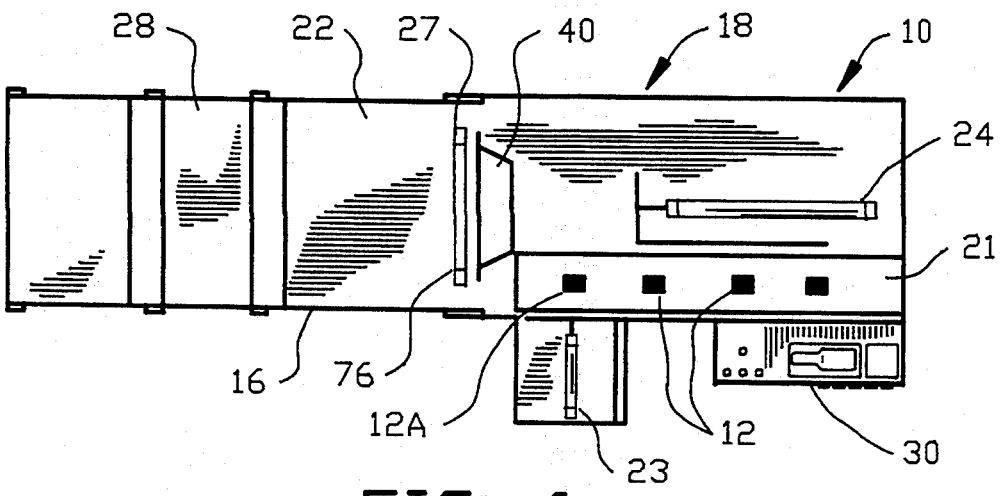
FIG. 6 is a top view of the wrapping machine with a first package in a first position.
Figure 7:
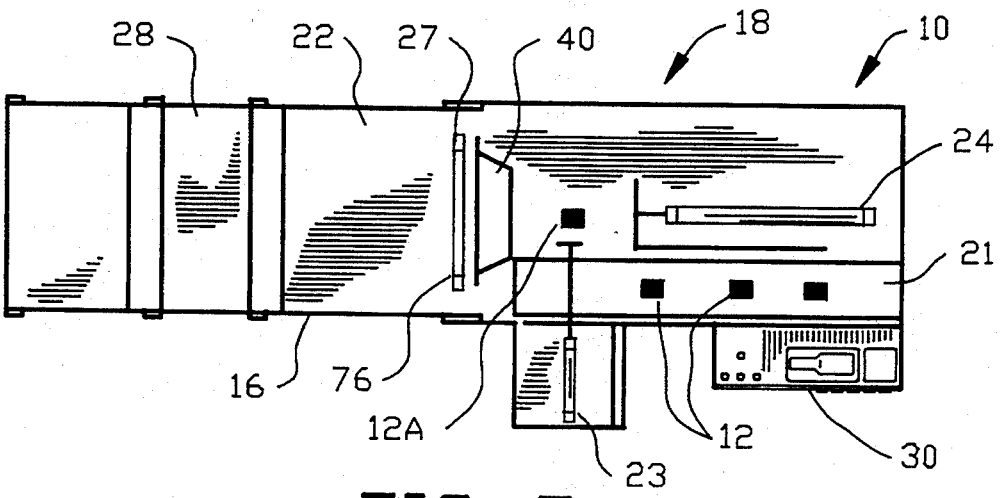
FIG. 7 is a top view similar to FIG. 6 with the first package in a second position.
Figure 8:
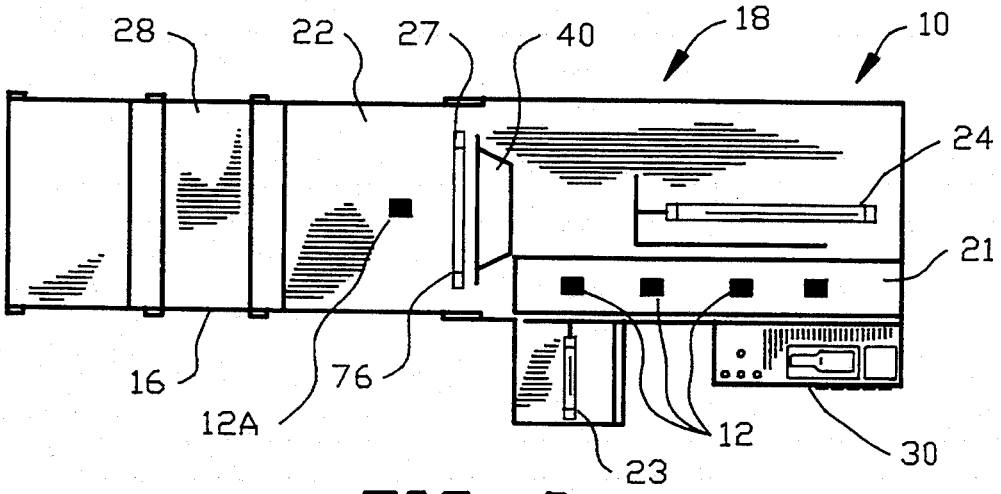
FIG. 8 is a top view similar to FIG. 6 with the first package in a third position.

FIGS. 6–8 are top views illustrating the operation of the wrapping machine 10 of FIG. 1. FIG. 6 illustrates a plurality of packages 12 moving on the first conveyor 21 with a first package 12A engaging a stop 70 whereat a lateral pusher 23 laterally displaces the first package 12A in front of the wrapping station 26.

FIG. 7 illustrates the pusher 24 moving the first package 12A through the wrapping station 26 whereat the wrapping sheet 36 is formed into the tube 66 with the package 12A disposed within the tube 66. The pusher 24 moves the first package 12A within the tube 66 through the wrapping station 26 and passed a sealing station 27 onto the second conveyor 22. The sealing station 27 comprises a seal bar 76 for sealing a trailing edge of the tube (not shown) as should be well known to those skilled in the art. The second conveyor 22 moves the first package 12 within the tube 66 through the heat shrink oven 28 to form the completed wrapped package 14.

A major disadvantage of the wrapping machine 10 of the prior art, was the need to manually thread the first edge 36A of the wrapping sheet 36 between the first and second tube former plates 61 and 62. The manually threading of the wrapping sheet 36 involved the passing of the wrapping sheet 36 through the forming tunnel 64 by an operator. The first and second edges 36A and 36B of the wrapping sheet 36 were then disposed above the second tube former plate 62. Thereafter, the operator had to manually thread the first edge 36A of the wrapping sheet 36 below the second tube former plate 62. Since the wrapping station 26 is located adjacent the sealing station 27 and near the heat shrink oven 28, it was common for an operator to be burned during this threading process. Furthermore, there was no provision in the prior art wrapping machines to insure that the first edge 36A of the wrapping sheet 36 was maintained below the second tube former plate 62. In many cases, an unequal tension between the first and second edges 36A and 36B on the wrapping sheet 36 caused the first edge 36A of the wrapping sheet 36 to move above the second tube former plate 62. If the first edge 36A of the wrapping sheet 36 move above the second tube former plate 62, defective wrapped packages 14 were produced by the wrapping machine. Accordingly, the operation of the wrapping machine had to be terminated and the first edge 36A of the wrapping sheet 36 had to be manually threaded below the second tube former plate 62.

Figures 9, 9A, 9B, 9C:
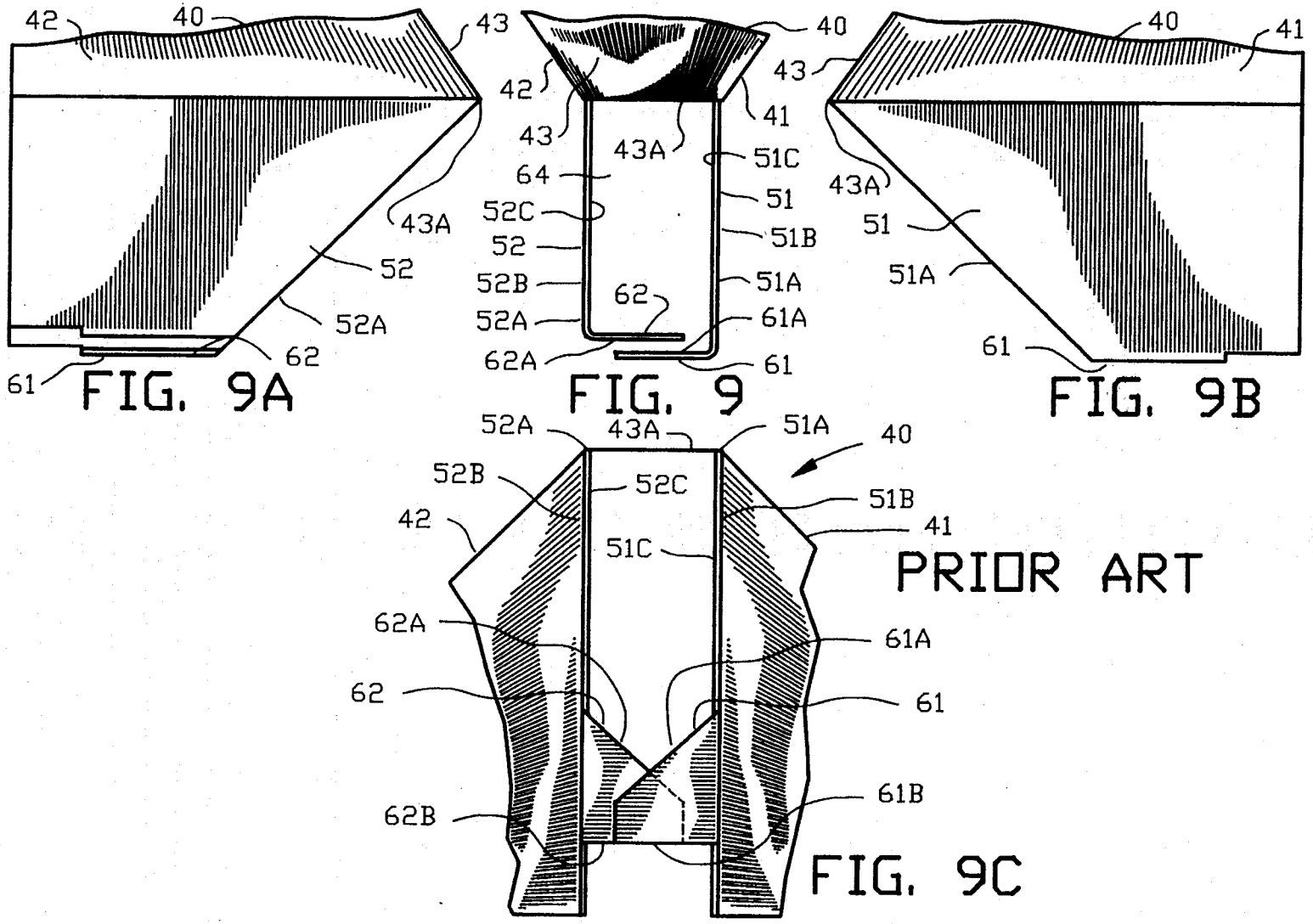
FIG. 9A PRIOR ART
FIG. 9 is front view of a tube former of the prior art without a wrapping sheet.
FIG. 9A is a left side view of FIG. 9.
FIG. 9B is a right side view of FIG. 9.
FIG. 9C is a bottom view of FIG. 9.

FIGS. 9—9C illustrate a front view, a left side view, a right side view and a bottom view, respectively, of the tube former 40 of the prior art. The tube former 40 is shown without the wrapping sheet 36 disposed thereon.

Figures 10, 10A, 10B, 10C:
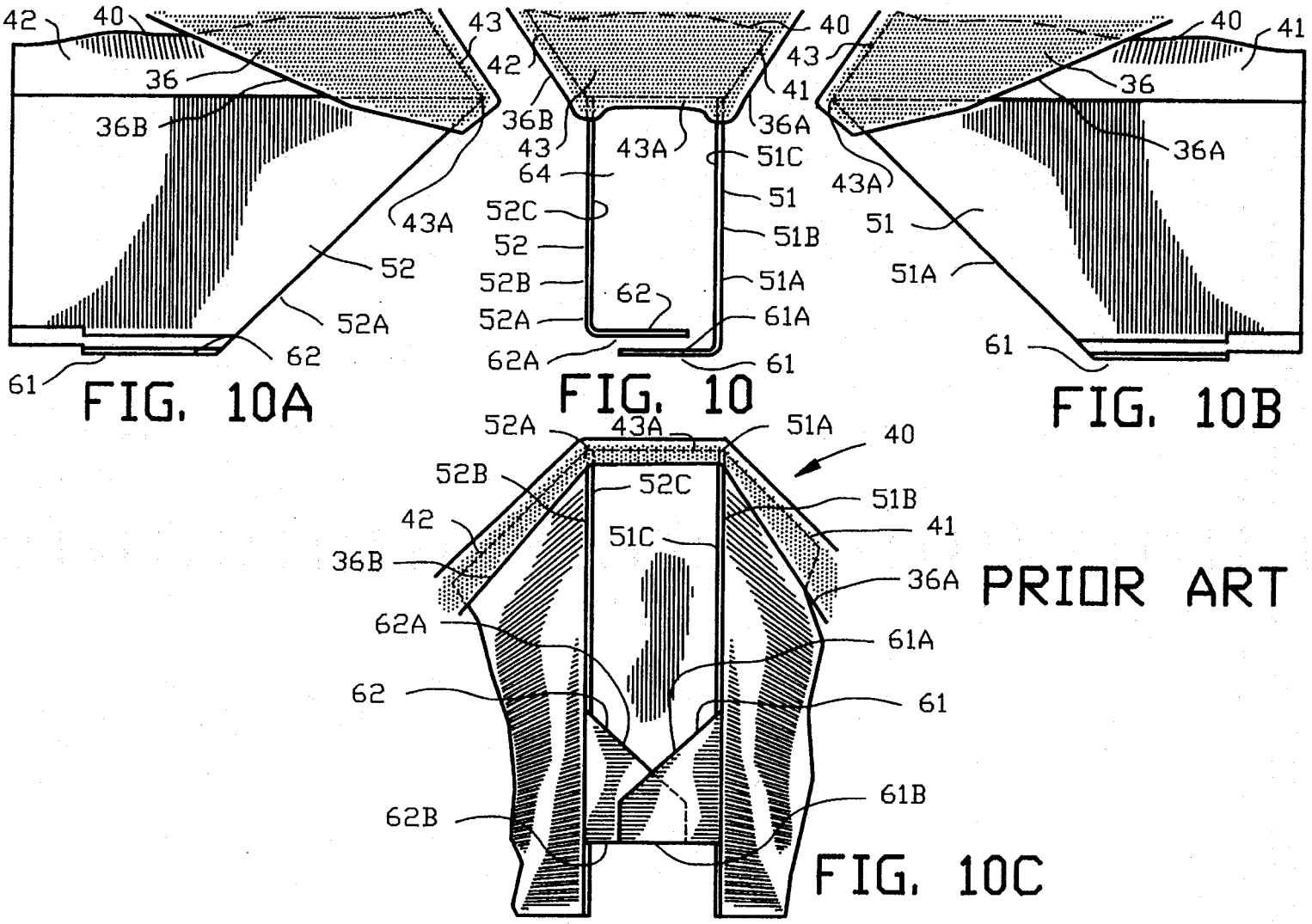
FIG. 10B PRIOR ART
FIG. 10 is front view of a tube former of the prior art with a wrapping sheet in a first position.
FIG. 10A is a left side view of FIG. 10.
FIG. 10B is a right side view of FIG. 10.
FIG. 10C is a bottom view of FIG. 10.

FIGS. 10—10C illustrate a front view, a left side view, a right side view and a bottom view, respectively, of the tube former 40 of the prior art. The tube former 40 is shown with the wrapping sheet 36 disposed on the first and second upper tube former walls 41 and 42 and the upper front wall 43. The wrapping sheet 36 is shown being pulled near the top of the first and second lower tube former walls 51 and 52 and engaging the front edges 51A and 52A and the front edge 43A.

Figures 11, 11A, 11B, 11C, 11D, 11E:
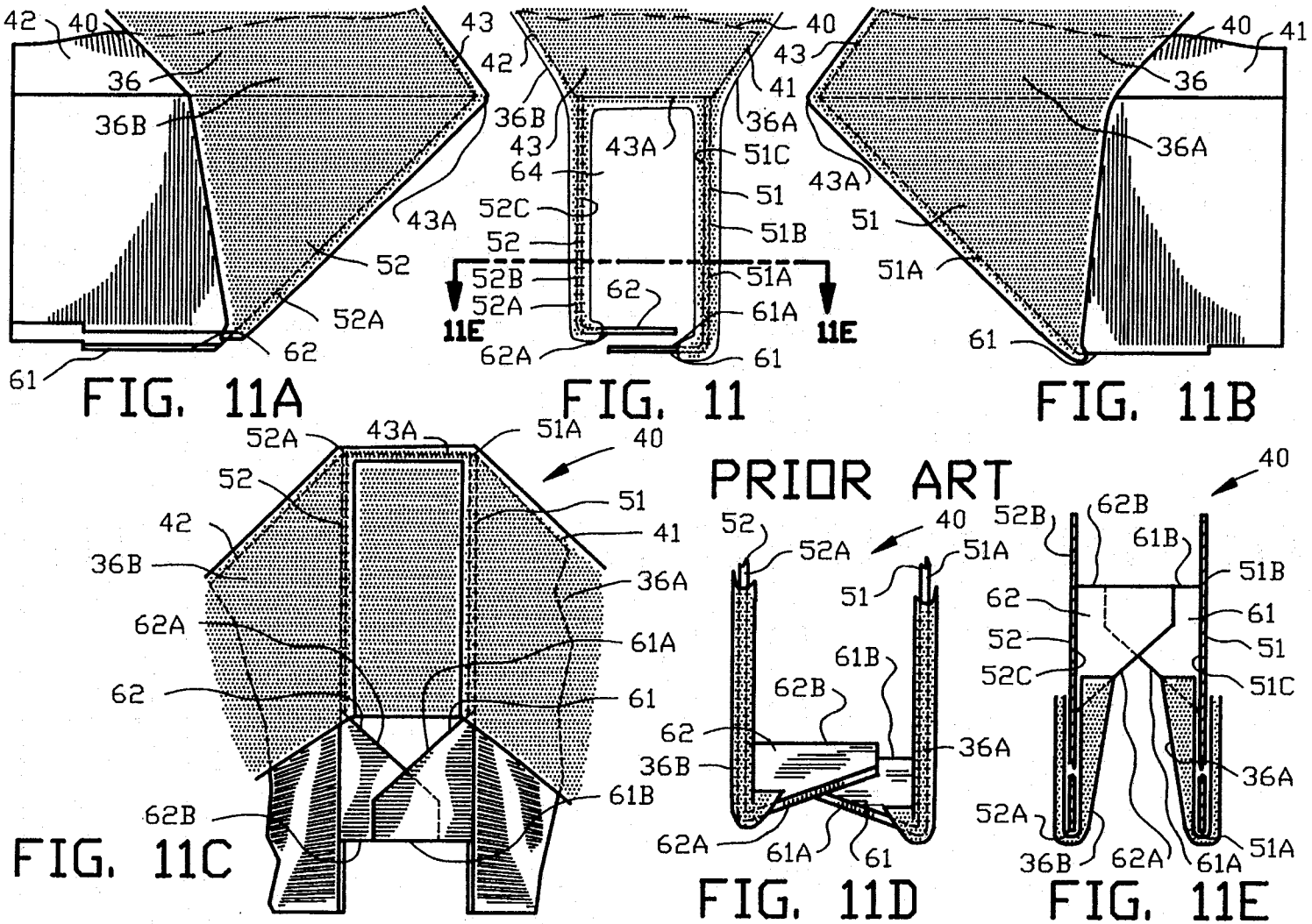
FIG. 11 is front view of a tube former of the prior art with the wrapping sheet in a second position.
FIG. 11A is a left side view of FIG. 11.
FIG. 11B is a right side view of FIG. 11.
FIG. 11C is a bottom view of FIG. 11.
FIG. 11D is an angled front view of FIG. 11.
FIG. 11E is a sectional view along line 11E—11E in FIG. 11.

FIGS. 11—11C illustrate a front view, a left side view, a right side view and a bottom view, respectively, of the tube former 40 of the prior art. FIG. 11D is an angled front view of FIG. 11 whereas FIG. 11E is a sectional view along line 11E—11E in FIG. 11. The wrapping sheet 36 is shown being pulled along the first and second lower tube former walls 51 and 52 and engaging the front edges 51A and 52A and the front edge 43A. The first and second edges 36A and 36B of the wrapping sheet 36 is shown being pulled near the first and second tube former plates 61 and 62.

As best shown in FIG. 11D, the first edge 36A of the wrapping sheet 36 will pass above the second tube former plate 62. The first edge 36A of the wrapping sheet 36 will pass above the second tube former plate 62 since there is means for threading the first edge 36A of the wrapping sheet 36 under the second tube former plate 62.

Figures 12, 12A, 12B, 12C, 12D, 12E:
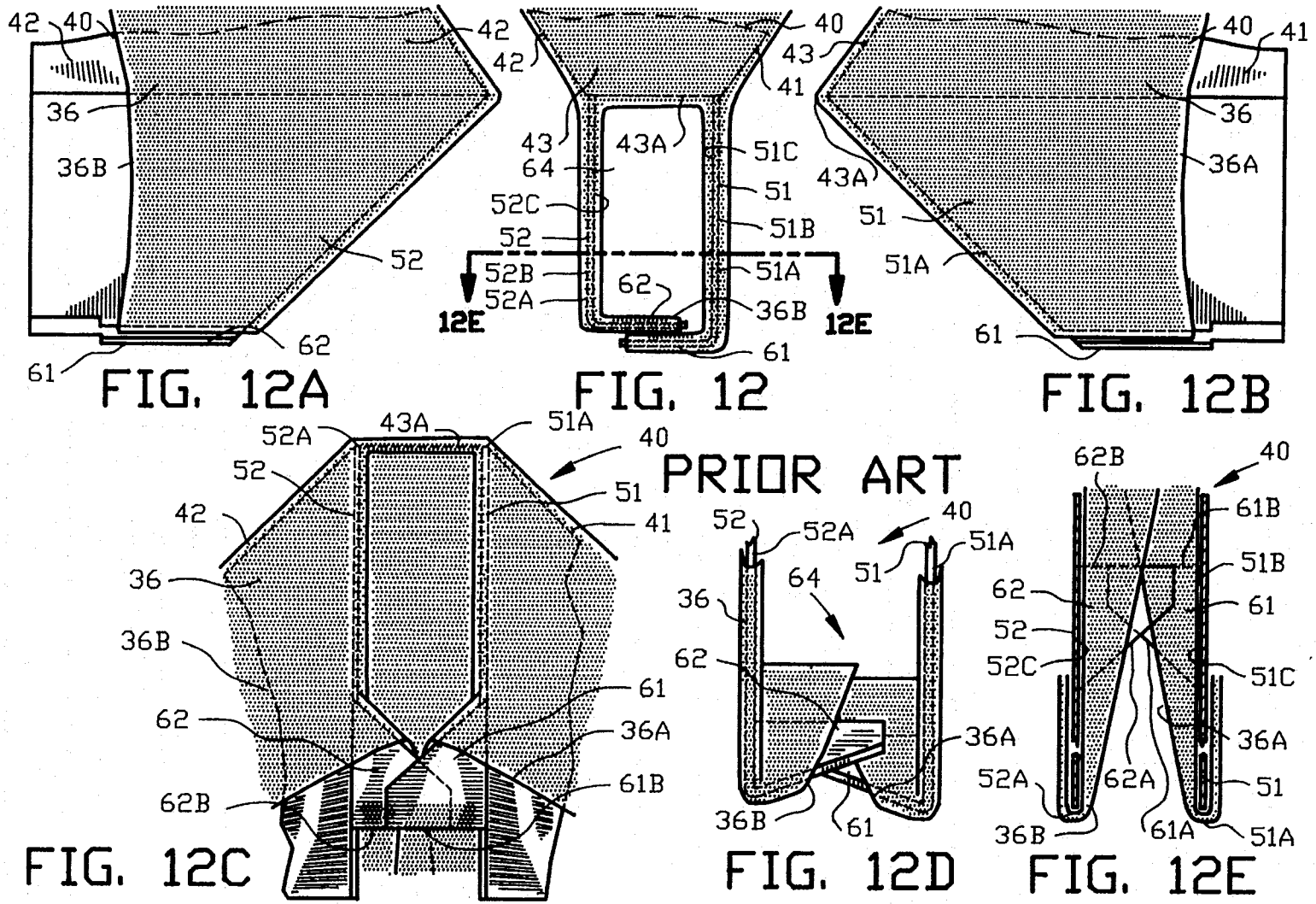
PRIOR ART FIG. 12A
FIG. 12 is front view of a tube former of the prior art with the wrapping sheet in a third position.
FIG. 12A is a left side view of FIG. 12.
FIG. 12B is a right side view of FIG. 12.
FIG. 12C is a bottom view of FIG. 12.
FIG. 12D is an angled front view of FIG. 12.
FIG. 12E is a sectional view along line 12E—12E in FIG. 12.

FIGS. 12—12C illustrate a front view, a left side view, a right side view and a bottom view, respectively, of the tube former 40 of the prior art. FIG. 12D is an angled front view of FIG. 12 whereas FIG. 12E is a sectional view along line 12E—12E in FIG. 12. The wrapping sheet 36 is shown being pulled along the first and second lower tube former walls 51 and 52 and engaging the front edges 51A and 52A and the front edge 43A through the forming tunnel 64.

As best shown in FIG. 12D, the first edge 36A of the wrapping sheet 36 is shown passing below the second tube former plate 62. The first edge 36A of the wrapping sheet 36 has been manually threaded under the second tube former plate 62. The first edge 36A overlaps the second edge 36B of the wrapping sheet 36 for forming the wrapping sheet 36 into the tube 66 to receive the package 12 within the tube 66.

Figure 13:
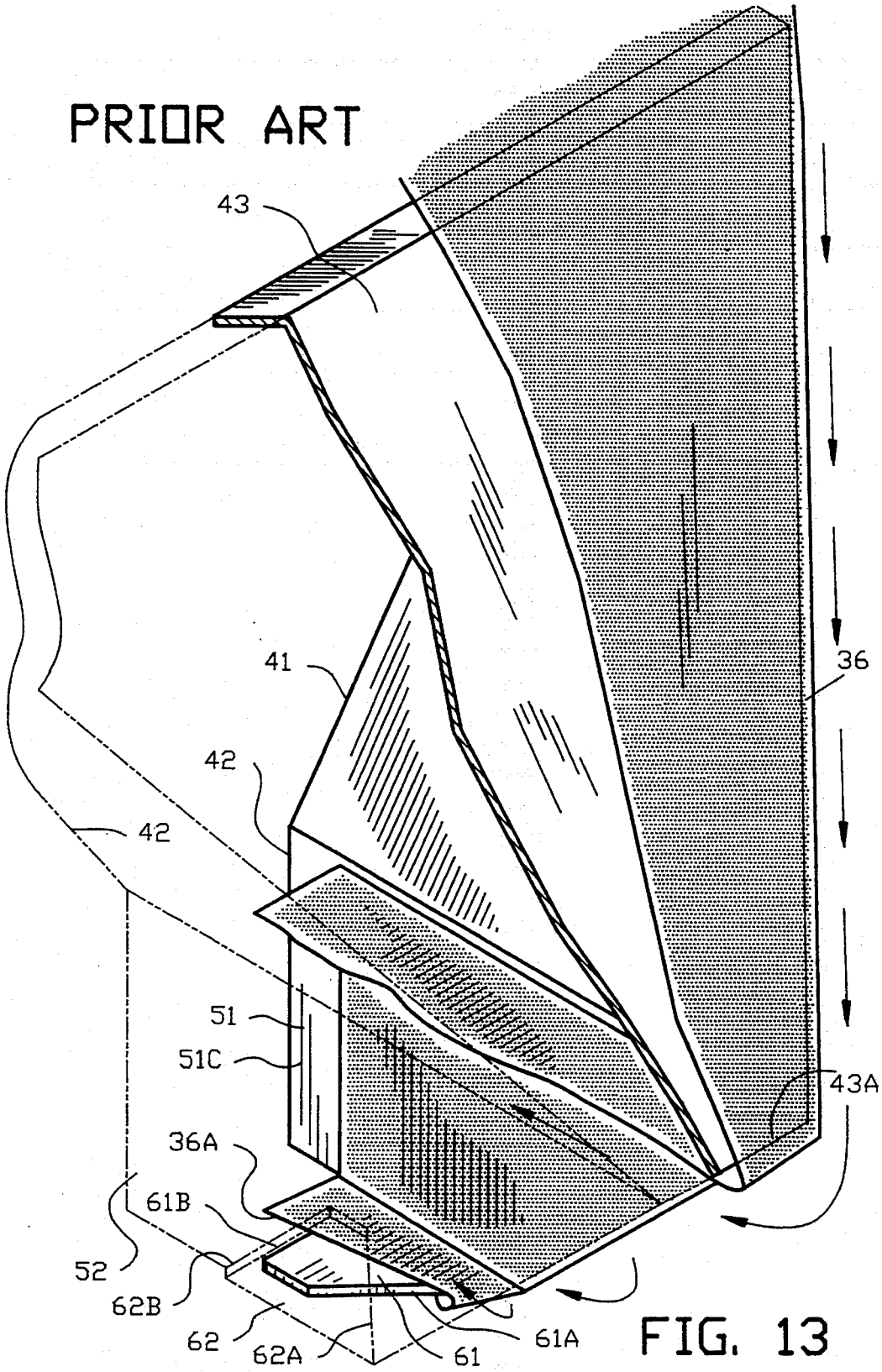
FIG. 13 is a partial isometric view illustrating a first lower tube former wall of the prior art tube former.

FIG. 13 is a partial isometric view illustrating the first lower tube former wall 51 and the first edge 36A of the wrapping sheet 36 passing above the first tube former plate 61 and below the second tube former plate 62 shown in phantom.

Figure 14:
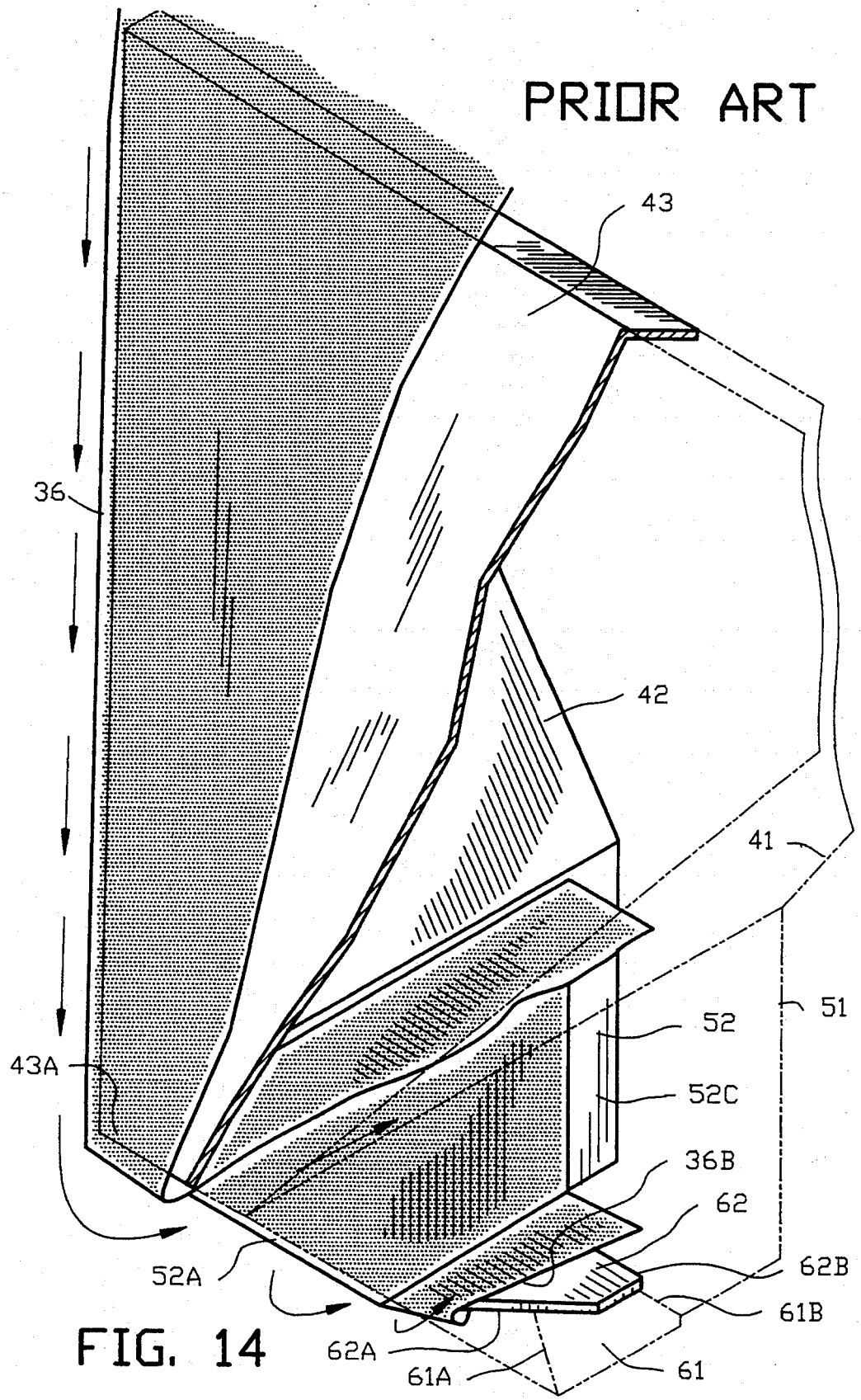
FIG. 14 is a partial isometric view illustrating a second lower tube former wall of the prior art tube former.

FIG. 14 is a partial isometric view illustrating the second lower tube former wall 52 and the second edge 36B of the wrapping sheet 36 passing above the second tube former plate 62.

Figure 15:
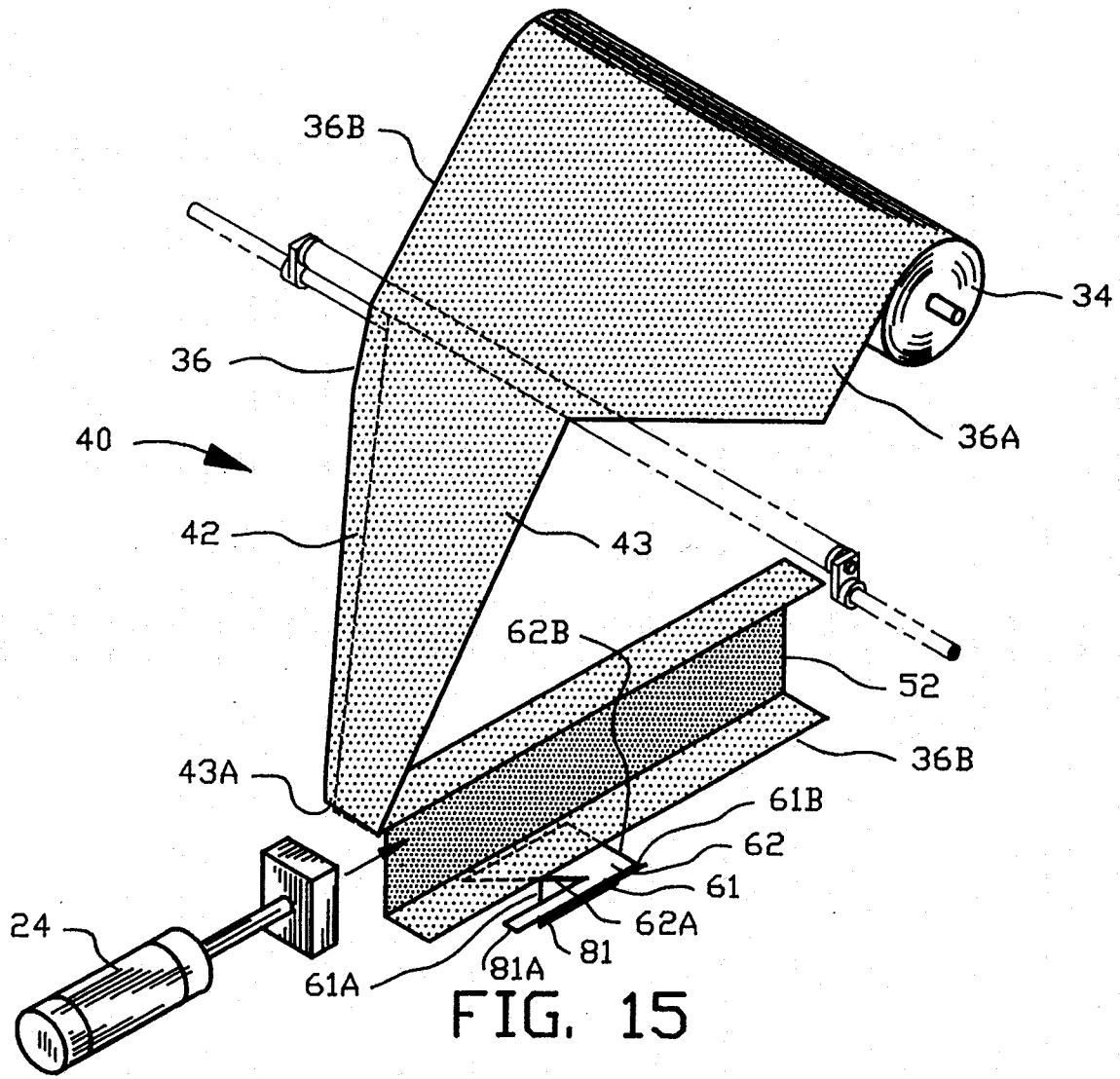
FIG. 15 is an isometric view of a first embodiment of a self threading tube former of the present invention incorporating a first guide plate.

FIG. 15 illustrates a first embodiment of the present invention comprising a self threader 80 for the wrapping machine 10 incorporated into the tube former 40. The self threader 80 includes a first guide plate 81 secured to the second tube former plate 62. Preferably, the second tube former plate 62 and the first guide plate 81 are formed of a metallic material such as stainless steel with the first guide plate 81 being integrally formed with the second tube former plate 63. The first guide plate 81 extends adjacent to the first lower tube former wall 51 forming a first groove 91 therebetween. Since the first guide plate 81 is secured to the second tube former plate 63, the first guide plate 81 is spaced above the first tube former plate 61.

A front edge 81A of the first guide plate 81 extends beyond the front edge 61A of the first tube former plate 61 for directing the first edge 36A of the wrapping sheet 36 below the second tube former plate 62. The first guide plate 81 insures that the first edge 36A of the wrapping sheet 36 is automatically threaded between the first tube former plate 61 and the second tube former plate 62. Furthermore, the first guide plate 81 insures that the first edge 36A of the wrapping sheet 36 will be maintained threaded between the first tube former plate 61 and the second tube former plate 62 during operation of the wrapping machine 10.

It has been found that when the front edge 81A of the first guide plate 81 is aligned equally with the front edge 61A of the first tube former plate 61, the first edge 36A of the wrapping sheet 36 is marginally directed below the second tube former plate 62. However, when the front edge 81A of the first guide plate 81 extends beyond the front edge 61A of the first tube former plate 61, the first edge 36A of the wrapping sheet 36 is consistently directed below the second tube former plate 62.

Figure 16:
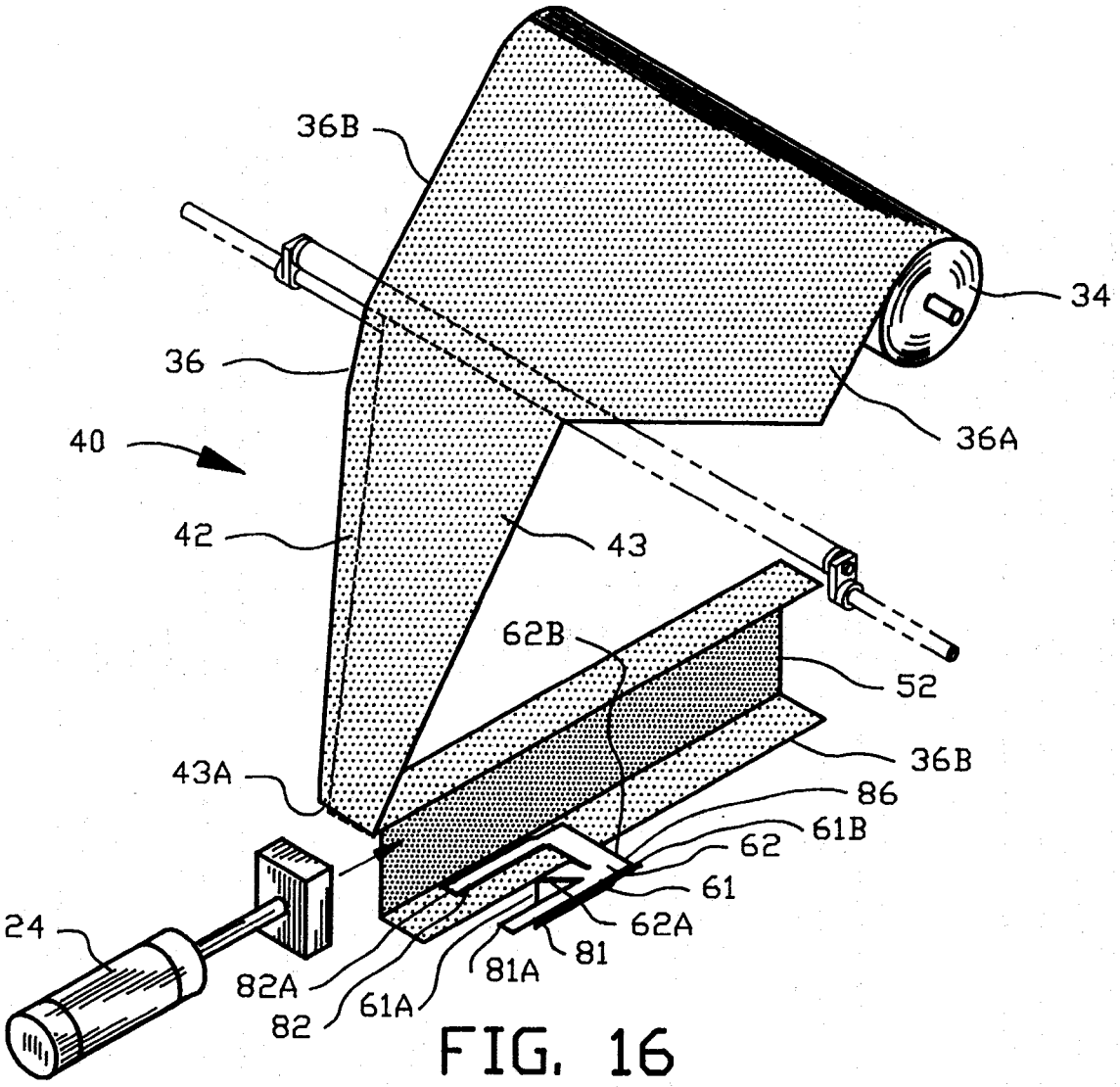
FIG. 16 is an isometric view of a second embodiment of a self threading tube former of the present invention incorporating a first and a second guide plate.

FIG. 16 illustrates a second embodiment of the present invention comprising a self threader 80A for the wrapping machine 10 incorporated into the tube former 40. The self threader 80A includes the first guide plate 81 secured to the second tube former plate 62. The first guide plate 81 extends adjacent to the first lower tube former wall 51.

The front edge 81A of the first guide plate 81 extends beyond the front edge 61A of the first tube former plate 61 for directing the first edge 36A of the wrapping sheet 36 below the second tube former plate 62. The first guide plate 81 insures that the first edge 36A of the wrapping sheet 36 is automatically threaded between the first tube former plate 61 and the second tube former plate 62.

In the second embodiment of the invention, the second tube former plate 62 includes a slot 86 for receiving the second edge 36B of the wrapping sheet 36. The slot 86 extends adjacent to the rear edge 61B of the first tube former plate 61. The slot 86 directs the second edge 36B of the wrapping sheet 36 into contact with the first edge 36A of the wrapping sheet 36. A second guide plate 82 is secured to the second tube former plate 62. The second guide plate 82 is shown secured to the second tube former plate 62 and extending adjacent to the second lower tube former wall 52.

Preferably, the second tube former plate 62 and the second guide plate 82 are formed of a metallic material such as stainless steel with the second guide plate 81 being integrally formed with the second tube former plate 63 through a bend 85. The second guide plate 82 extends adjacent to the second lower tube former wall 51 forming a second groove 92 therebetween. Since the second guide plate 82 is secured to the second tube former plate 62 through the bend 85, the second guide plate 82 is spaced above the second tube former plate 62.

A front edge 82A of the second guide plate 82 extends beyond the front edge 62A of the second tube former plate 62 for directing the second edge 36B of the wrapping sheet 36 into the slot 86. The second guide plate 82 insures that the second edge 36B of the wrapping sheet 36 is automatically threaded into the slot 86. Furthermore, the second guide plate 82 insures that the second edge 36B of the wrapping sheet 36 will be maintained threaded within the slot 86.

Figures 17, 17A, 17B, 17C:
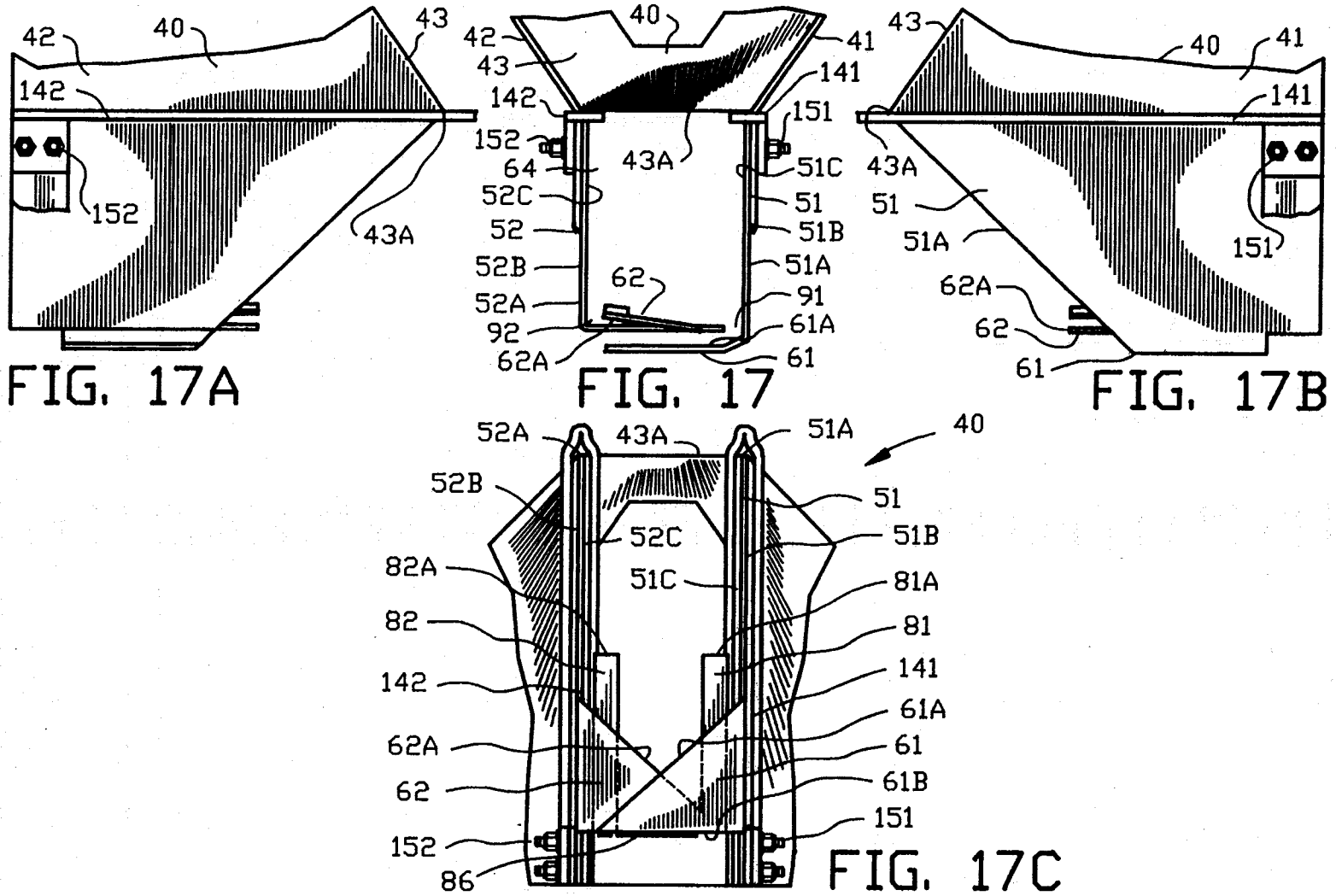
FIG. 17 is front view of the second embodiment of the self threading tube former of the present invention without a wrapping sheet.
FIG. 17A is a left side view of FIG. 17.
FIG. 17B is a right side view of FIG. 17.
FIG. 17C is a bottom view of FIG. 17.

FIGS. 17—17C illustrate a front view, a left side view, a right side view and a bottom view, respectively, of the second embodiment of the self threader 80A incorporating the present invention. The tube former 40 is shown without the wrapping sheet 36 disposed thereon.

Figures 18, 18A, 18B, 18C:
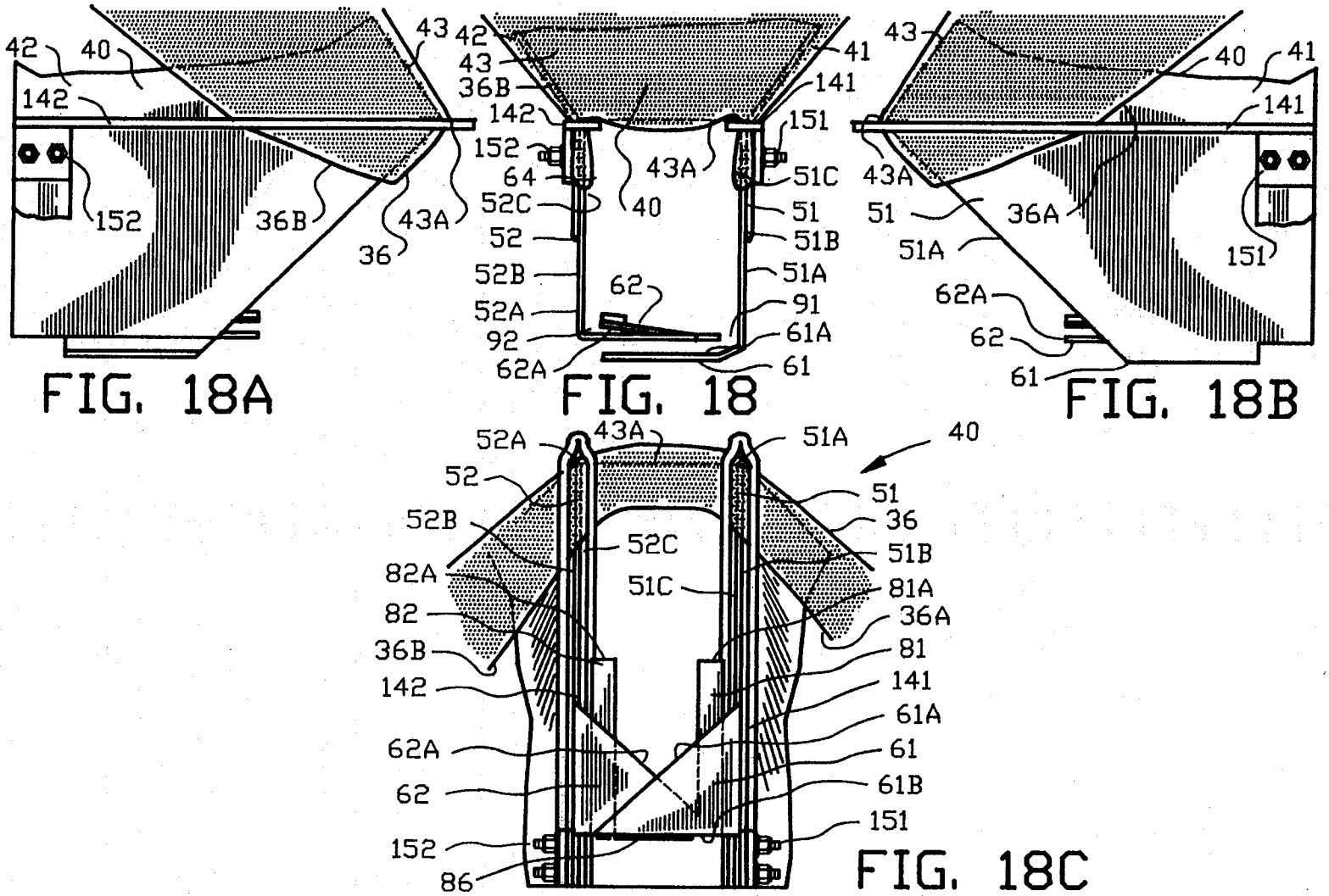
FIG. 18 is a front view of the second embodiment of the self threading tube former of the present invention with the wrapping sheet in a first position.
FIG. 18A is a left side view of FIG. 18.
FIG. 18B is a right side view of FIG. 18.
FIG. 18C is a bottom view of FIG. 18.

FIGS. 18—18C illustrate a front view, a left side view, a right side view and a bottom view, respectively, of the second embodiment of the self threader 80A incorporating the present invention. The tube former 40 is shown with the wrapping sheet 36 disposed on the first and second upper tube former walls 41 and 42 and the upper front wall 43. The wrapping sheet 36 is shown being pulled near the top of the first and second lower tube former walls 51 and 52 and engaging the front edges 51A and 52A and the front edge 43A.

Figures 19, 19A, 19B, 19C, 19D, 19E:
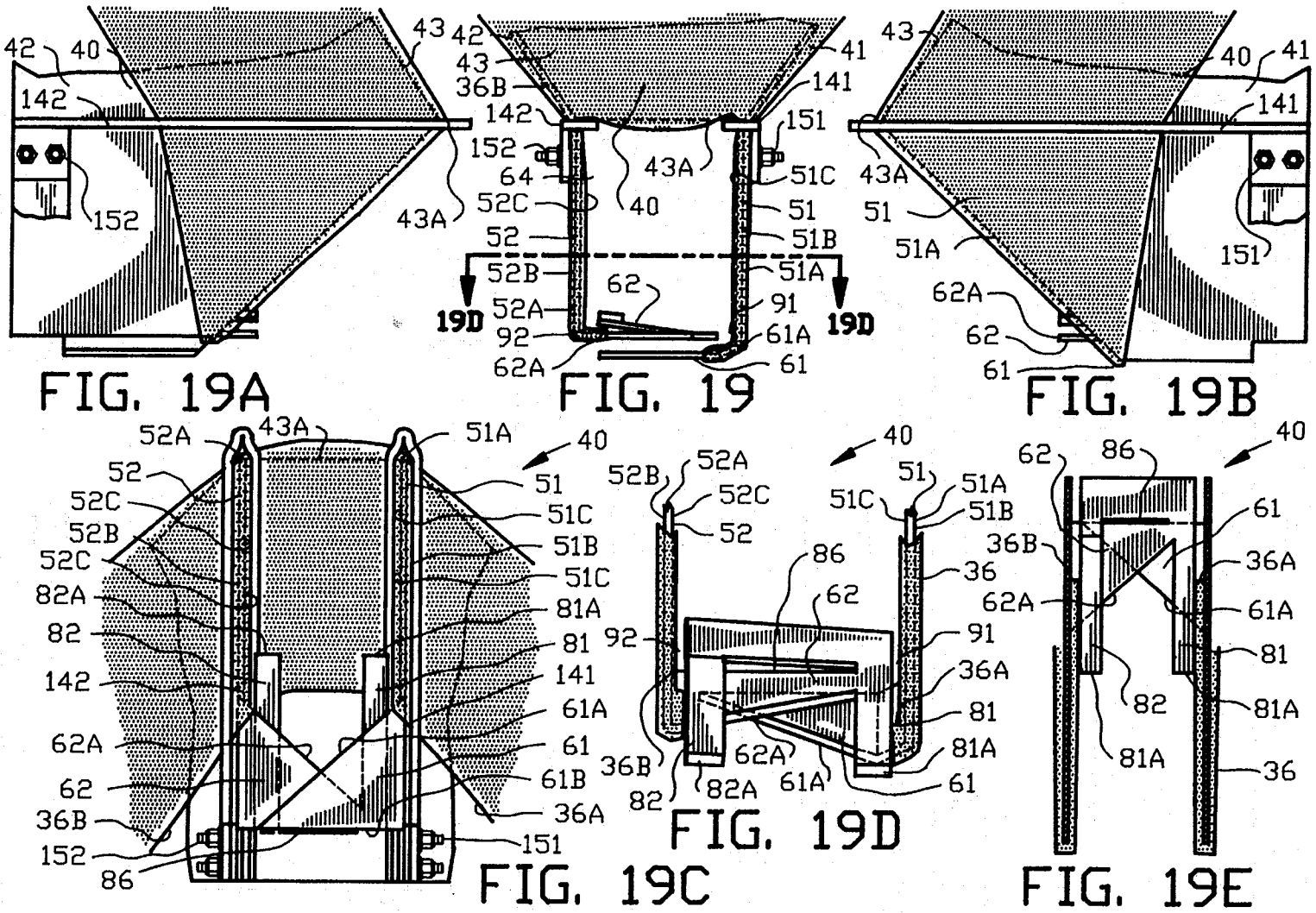
FIG. 19 is a front view of the second embodiment of the self threading tube former of the present invention with the wrapping sheet in a second position.
FIG. 19A is a left side view of FIG. 19.
FIG. 19B is a right side view of FIG. 19.
FIG. 19C is a bottom view of FIG. 19.
FIG. 19D is an angled front view of FIG. 19.
FIG. 19E is a sectional view along line 19E—19E in FIG. 19.

FIGS. 19–19C illustrate a front view, a left side view, a right side view and a bottom view, respectively, of the second embodiment of the self threader 80A incorporating the present invention. FIGS. 19D is an angled front view of FIG. 19 whereas FIG. 19E is a sectional view along line 19E–19E in FIG. 19. The wrapping sheet 36 is shown being pulled along the first and second lower tube former walls 51 and 52 and engaging the front edges 51A and 52A and the front edge 43A. The first and second edges 36A and 36B of the wrapping sheet 36 is shown being pulled near the first and second tube former plates 61 and 62.

As best shown in FIG. 19D, the front edge 81A of the first guide plate 81 extends beyond the front edge 61A of the first tube former plate 61. Accordingly, the first edge 36A of the wrapping sheet 36 is directed by the first guide plate 81 to pass through the first groove 91 and below the second tube former plate 62. The first edge 36A of the wrapping sheet 36 will pass below the second tube former plate 62 since the first guide plate 81 threads the first edge 36A of the wrapping sheet 36 under the second tube former plate 62.

In a similar manner, the front edge 82A of the second guide plate 82 extends beyond the front edge 62A of the second tube former plate 62. Accordingly, the second edge 36B of the wrapping sheet 36 is directed by the second guide plate 82 to pass through the second groove 91 into the slot 86. The second edge 36A of the wrapping sheet 36 will pass into the slot 86 of the second tube former plate 62 since the second guide plate 82 threads the second edge 36B of the wrapping sheet 36 into the slot 86 of the second tube former plate 62.

Figures 20, 20A, 20B, 20C, 20D, 20E:
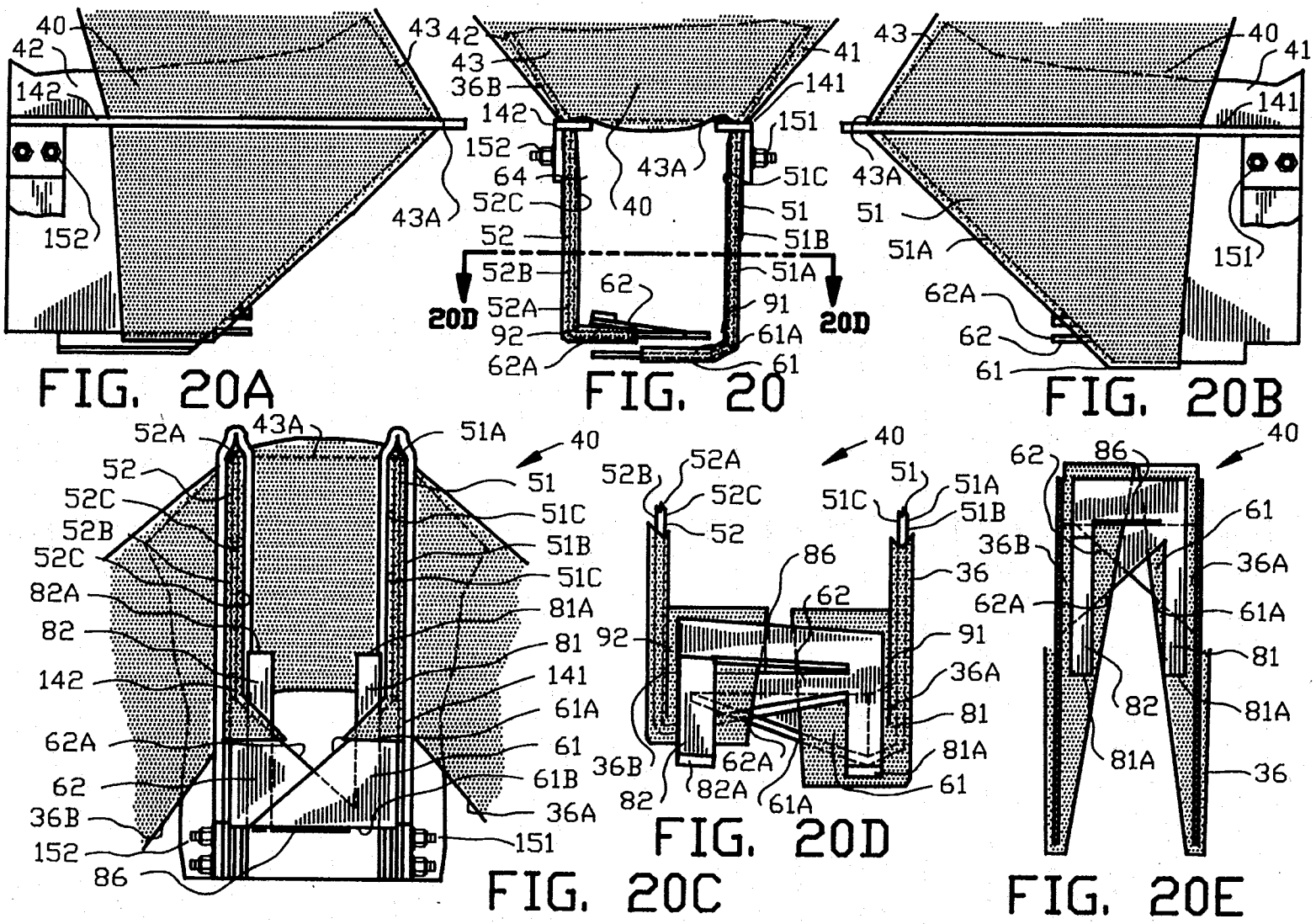
FIG. 20 is a front view of the second embodiment of the self threading tube former of the present invention with the wrapping sheet in a third position.
FIG. 20A is a left side view of FIG. 20.
FIG. 20B is a right side view of FIG. 20.
FIG. 20C is a bottom view of FIG. 20.
FIG. 20D is an angled front view of FIG. 20.
FIG. 20E is a sectional view along line 20E—20E in FIG. 20.

FIGS. 20—20C illustrate a front view, a left side view, a right side view and a bottom view, respectively, of the second embodiment of the self threader 80A incorporating the present invention. FIG. 20D is an angled front view of FIG. 20 whereas FIG. 20E is a sectional view along line 20E—20E in FIG. 20. The wrapping sheet 36 is shown being pulled along the first and second lower tube former walls 51 and 52 and engaging the front edges 51A and 52A and the front edge 43A through the forming tunnel 64.

As best shown in FIG. 20D, the first edge 36A of the wrapping sheet 36 is shown passing below the second tube former plate 62. The first edge 36A of the wrapping sheet 36 has been automatically threaded under the second tube former plate 62. The second edge 36B of the wrapping sheet 36 is shown passing through the slot 86 in the second tube former plate 62. The second edge 36A of the wrapping sheet 36 has been automatically threaded into the slot 86 of the second tube former plate 62. The first edge 36A overlaps the second edge 36B of the wrapping sheet 36 for forming the wrapping sheet 36 into the tube 66 to receive the package 12 within the tube 66.

Figure 21:
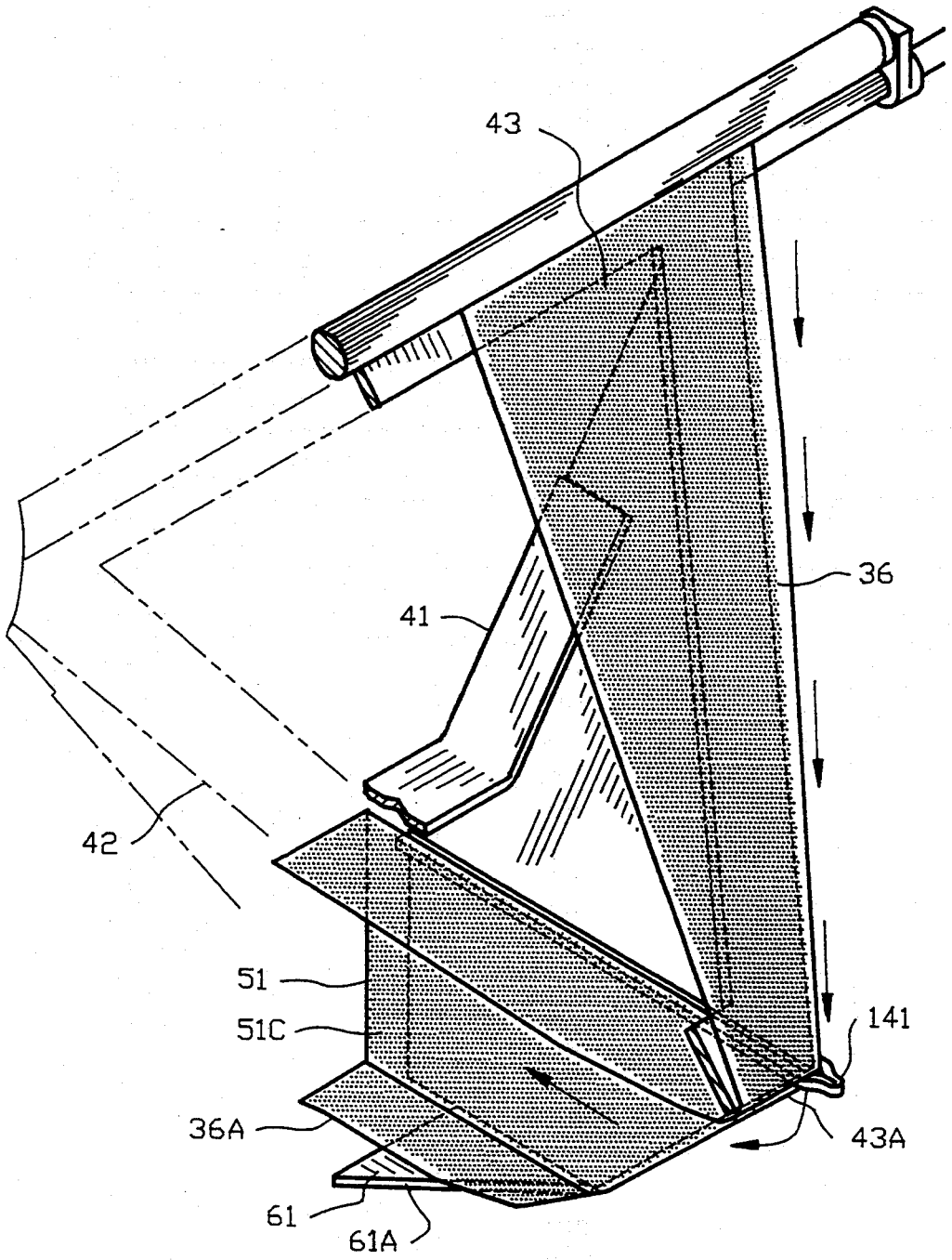
FIG. 21 is a partial isometric view illustrating a first lower tube former wall of the second embodiment of the self threading tube former of the present invention.

FIG. 21 is a partial isometric view illustrating the first lower tube former wall 51 and the first edge 36A of the wrapping sheet 36 passing above the first tube former plate 61 and below the second tube former plate 62 shown in phantom.

Figure 22:
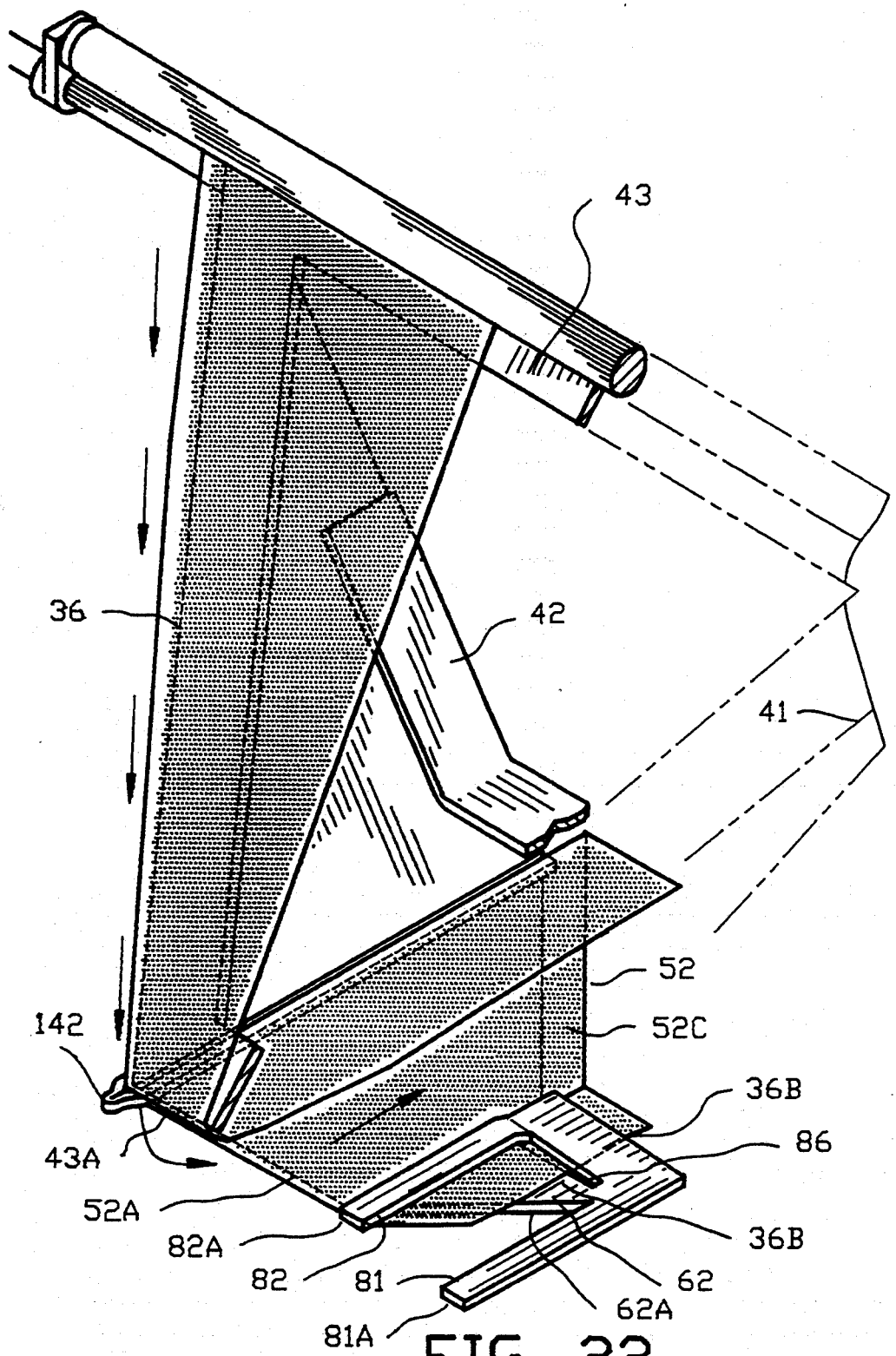
FIG. 22 is a partial isometric view illustrating a second lower tube former wall of the second embodiment of the self threading tube former of the present invention.

FIG. 22 is a partial isometric view illustrating the second lower tube former wall 52 and the second edge 36B of the wrapping sheet 36 passing above the second tube former plate 62 and into the slot 86.

FIG. 23 is an isometric view of a third embodiment of the self threader 80B for the tube former 40. FIG. 24 is an exploded view of the self threader 80B of FIG. 23. In this embodiment, the first guide plate 81 is integrally formed with the second guide plate 82. The first and second guide plates 81 and 82 are formed from a unitary plate 94 having a generally V-shape aperture 95 for defining the front edges 81A and 82A of the first and second guide plates 81 and 82. The unitary plate 94 is secured to the second tube former plate 62 through a spacer plate 96. The spacer plate 96 is contoured to partially encircle the slot 86 and for spacing the second guide plate 82 above the second tube former plate 62. The unitary plate 94 may be secured to the second tube former plate 62 through the spacer plate 96 by suitable means such as welding or the like.

The first edge 36A of the wrapping sheet 36 is directed by the first guide plate 81 to pass through the first groove 91 and below the second tube former plate 62 to thread the first edge 36A of the wrapping sheet 36 under the second tube former plate 62. Although the first guide plate 81 is spaced a greater distance from the first tube former plate 61 relative to the other embodiments of the invention, the first guide plate 81 still functions since the front edge 81A of the first guide plate 81 extends beyond the front edge 61A of the first tube former plate 62. In a similar manner, the front edge 82A of the second guide plate 82 extends beyond the front edge 62A of the second tube former plate 62. Accordingly, the second edge 36B of the wrapping sheet 36 is directed by the second guide plate 82 to pass through the second groove 91 into the slot 86.

Figures 25, 25A, 25B, 25C:
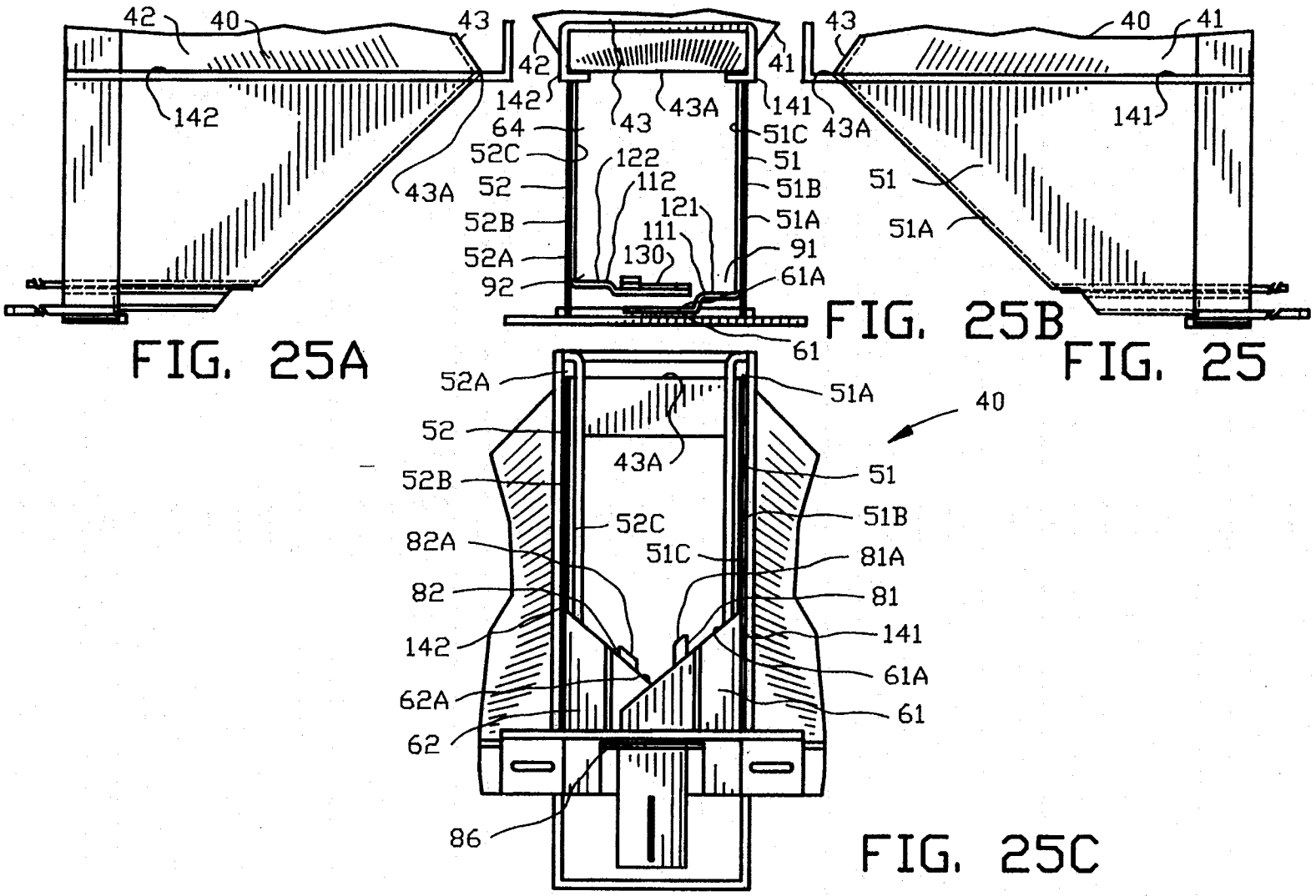
FIG. 25 is front view of a fourth embodiment of the self threading tube former of the present invention without a wrapping sheet.
FIG. 25A is a left side view of FIG. 25.
FIG. 25B is a right side view of FIG. 25.
FIG. 25C is a bottom view of FIG. 25.

FIGS. 25—25C illustrate a front view, a left side view, a right side view and a bottom view, respectively, of a fourth embodiment of the self threader 80C incorporating the present invention. The tube former 40 is shown without the wrapping sheet 36 disposed thereon. In this fourth embodiment, each of the first and second tube former plates 61 and 62 includes a first and a second bend 111 and 112 for defining a first and a second slide 121 and 122 in the first and second tube former plates 61 and 62.

In a manner similar to the second embodiment shown in FIGS. 16–22, the first and second bends 111 and 112 define a recess 130 with the first and second guide plates 81 and 82, the slot 86 and the first and second grooves 91 and 92 being located in the recess 130. The package 12 move on the slides 121 and 122 through the forming tunnel 64 when the invention is used with a vacuum belt conveyor 22A for holding the wrapping sheet 36 to move the package 12 as described with reference to FIG. 2.

Figures 26, 26A, 26B, 26C:
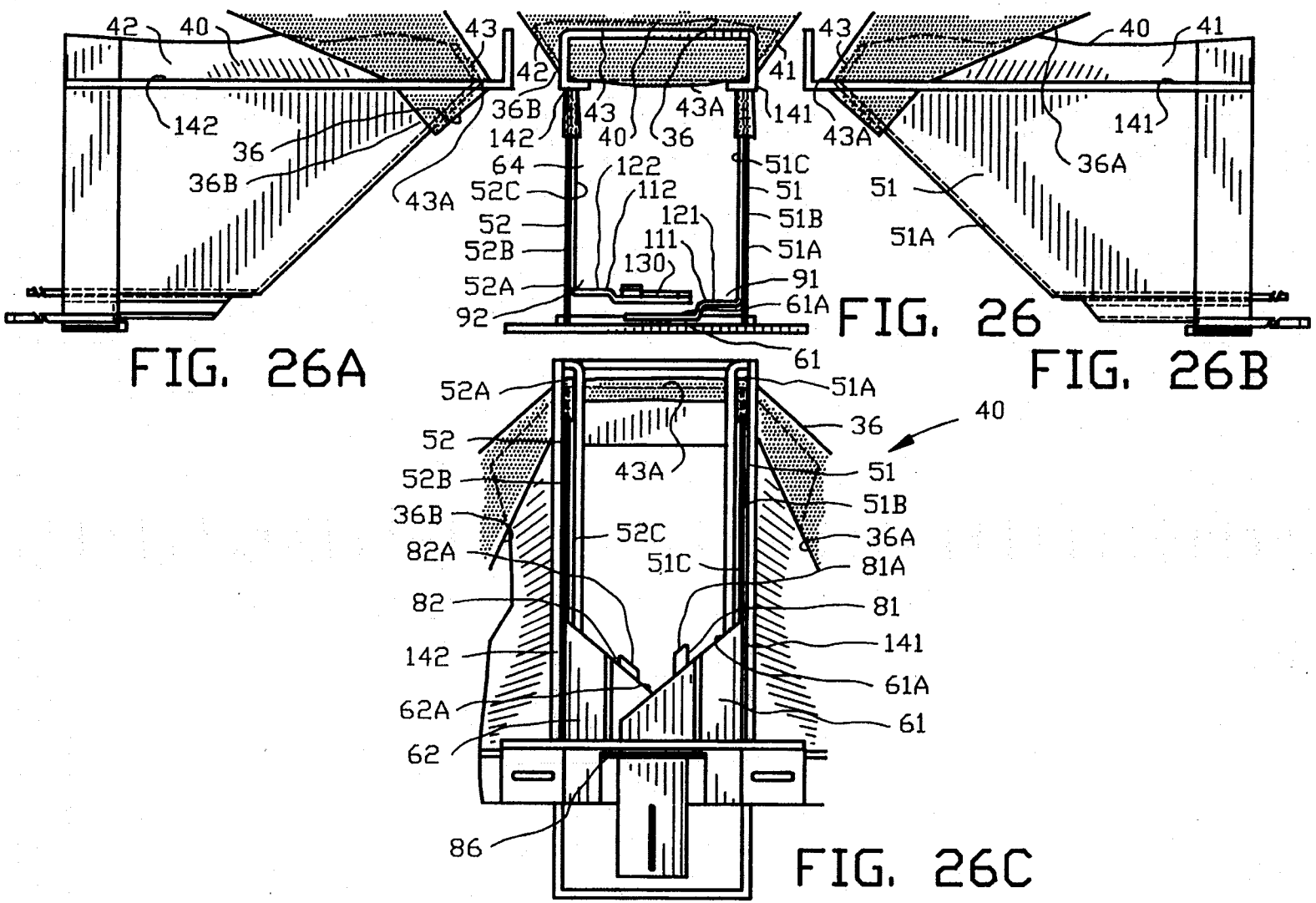
FIG. 26 is a front view of the fourth embodiment of the self threading tube former of the present invention with a wrapping sheet in a first position.
FIG. 26A is a left side view of FIG. 26.
FIG. 26B is a right side view of FIG. 26.
FIG. 26C is a bottom view of FIG. 26.

FIGS. 26—26C illustrate a front view, a left side view, a right side view and a bottom view, respectively, of the fourth embodiment of the self threader 80C incorporating the present invention. The tube former 40 is shown with the wrapping sheet 36 disposed on the first and second upper tube former walls 41 and 42 and the upper front wall 43. The wrapping sheet 36 is shown being pulled near the top of the first and second lower tube former walls 51 and 52 and engaging the front edges 51A and 52A and the front edge 43A.

Figures 27, 27A, 27B, 27C, 27D, 27E:
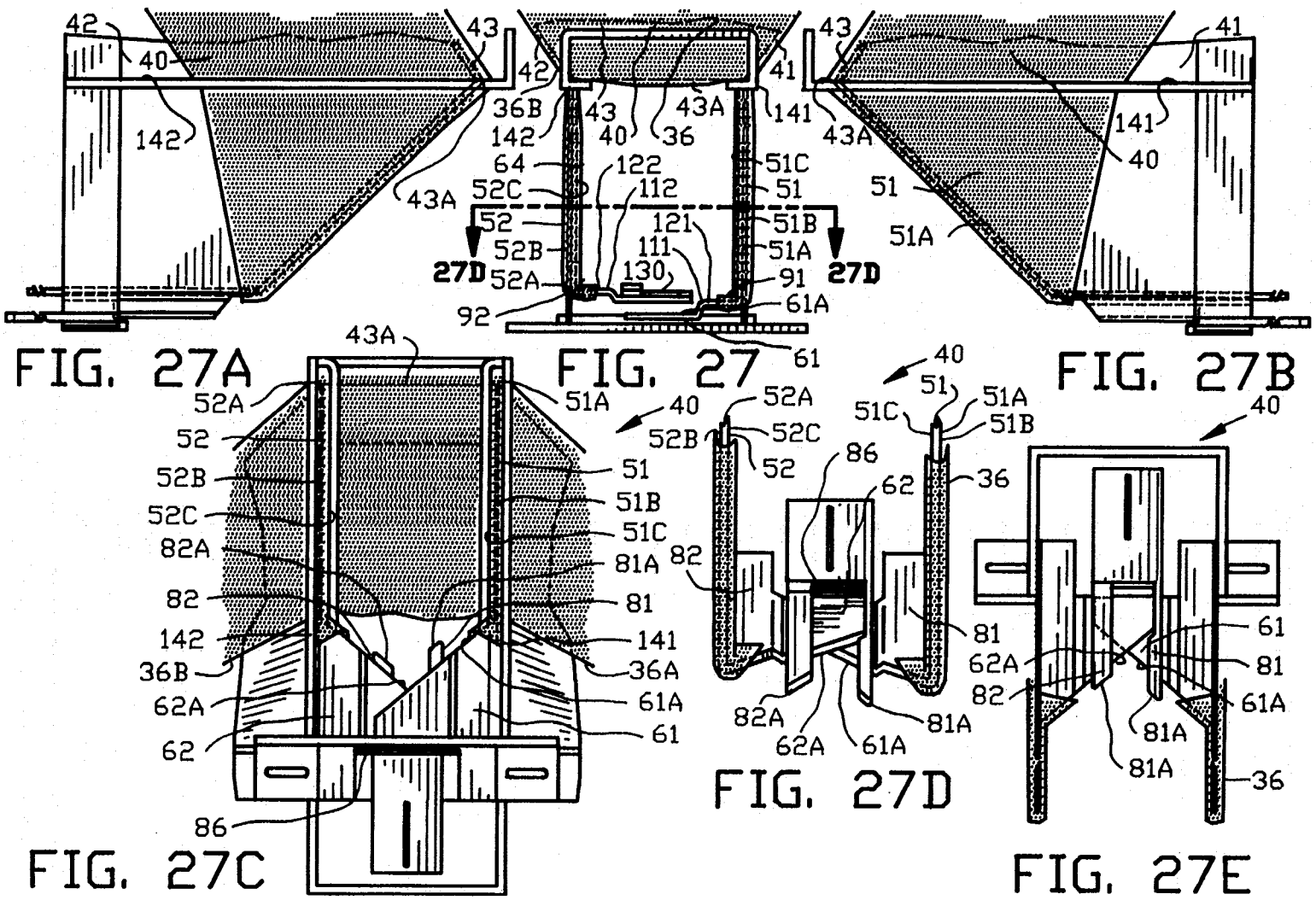
FIG. 27 is a front view of the fourth embodiment of the self threading tube former of the present invention with the wrapping sheet in a second position
FIG. 27A is a left side view of FIG. 27.
FIG. 27B is a right side view of FIG. 27.
FIG. 27C is a bottom view of FIG. 27.
FIG. 27D is an angled front view of FIG. 27.
FIG. 27E is a sectional view along line 27E—27E in FIG. 27.

FIGS. 27—27C illustrate a front view, a left side view, a right side view and a bottom view, respectively, of the fourth embodiment of the self threader 80C incorporating the present invention. FIG. 27D is an angled front view of FIG. 27 whereas FIG. 27E is a sectional view along line 27E—27E in FIG. 27. The wrapping sheet 36 is shown being pulled along the first and second lower tube former walls 51 and 52 and engaging the front edges 51A and 52A and the front edge 43A. The first and second edges 36A and 36B of the wrapping sheet 36 is shown being pulled near the first and second tube former plates 61 and 62.

As best shown in FIG. 27D, the front edge 81A of the first guide plate 81 extends beyond the front edge 61A of the first tube former plate 61. Accordingly, the first edge 36A of the wrapping sheet 36 is directed by the first guide plate 81 to pass through the first groove 91 into the recess 130 and below the second tube former plate 62. The first edge 36A of the wrapping sheet 36 will pass below the second tube former plate 62 since the first guide plate 81 threads the first edge 36A of the wrapping sheet 36 under the second tube former plate 62.

In a similar manner, the front edge 82A of the second guide plate 82 extends beyond the front edge 62A of the second tube former plate 62. Accordingly, the second edge 36B of the wrapping sheet 36 is directed by the second guide plate 82 to pass through the second groove 91 into the recess 130 in enter the slot 86. The second edge 36A of the wrapping sheet 36 will pass into the slot 86 of the second tube former plate 62 since the second guide plate 82 threads the second edge 36B of the wrapping sheet 36 into the slot 86 of the second tube former plate 62.

Figures 28, 28A, 28B, 28C, 28D, 28E:
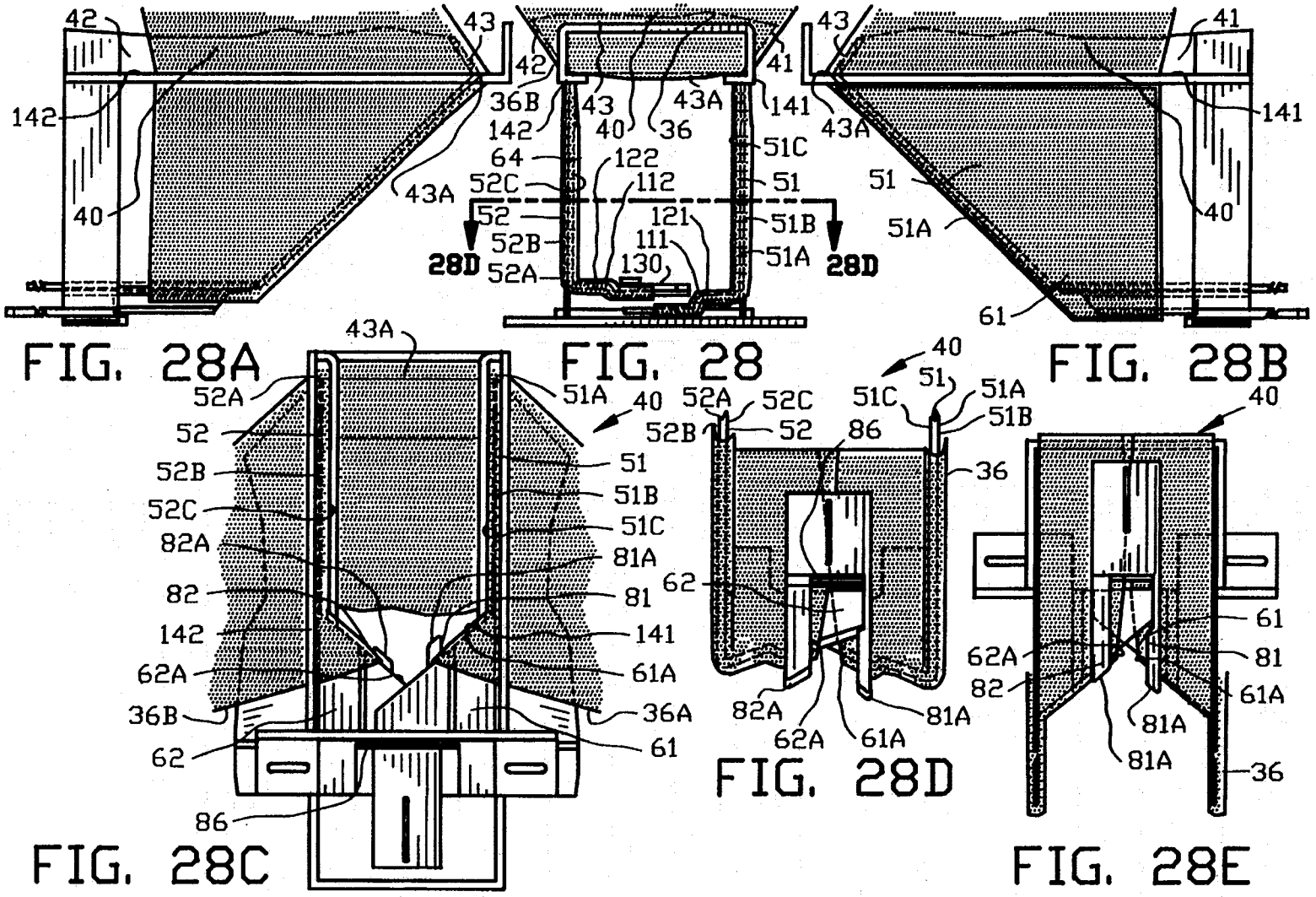
FIG. 28 is a front view of the fourth embodiment of the self threading tube former of the present invention with the wrapping sheet in a third position.
FIG. 28A is a left side view of FIG. 28.
FIG. 28B is a right side view of FIG. 28.
FIG. 28C is a bottom view of FIG. 28.
FIG. 28D is an angled front view of FIG. 28.
FIG. 28E is a sectional view along line 28E—28E in FIG. 28.

FIGS. 28—28C illustrate a front view, a left side view, a right side view and a bottom view, respectively, of the fourth embodiment of the self threader 80C incorporating the present invention. FIG. 28D is an angled front view of FIG. 28 whereas FIG. 28E is a sectional view along line 28E—28E in FIG. 28. The wrapping sheet 36 is shown being pulled along the first and second lower tube former walls 51 and 52 and engaging the front edges 51A and 52A and the front edge 43A through the forming tunnel 64.

As best shown in FIG. 28D, the first edge 36A of the wrapping sheet 36 is shown passing below the second tube former plate 62. The first edge 36A of the wrapping sheet 36 has been automatically threaded under the second tube former plate 62. The second edge 36B of the wrapping sheet 36 is shown passing through the slot 86 in the second tube former plate 62. The second edge 36A of the wrapping sheet 36 has been automatically threaded into the slot 86 of the second tube former plate 62. The first edge 36A overlaps the second edge 36B of the wrapping sheet 36 for forming the wrapping sheet 36 into the tube 66 to receive the package 12 within the tube 66.

Figure 29:
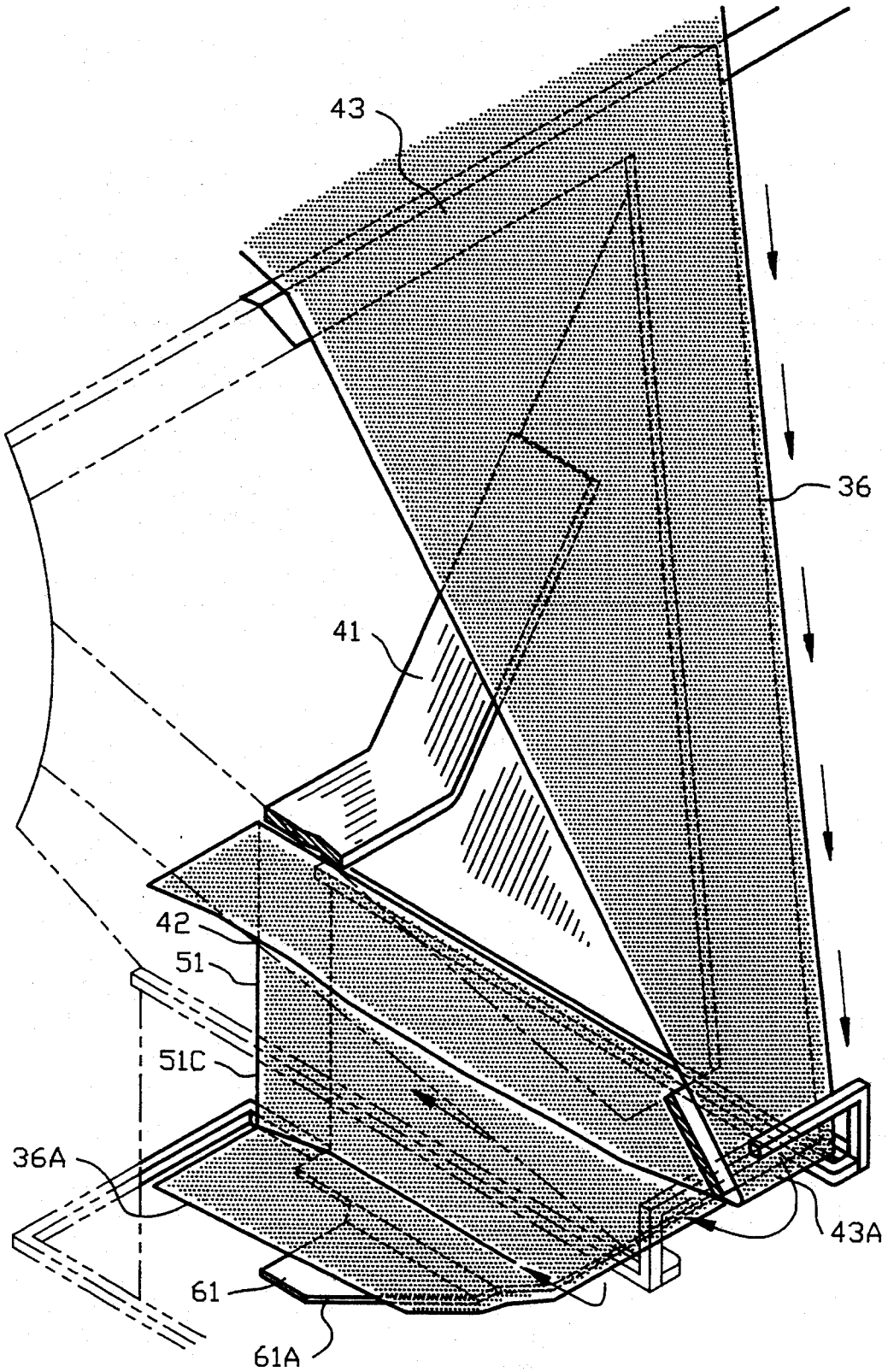
FIG. 29 is a partial isometric view illustrating a first lower tube former wall of the fourth embodiment of the self threading tube former of the present invention.

FIG. 29 is a partial isometric view illustrating the first lower tube former wall 51 and the first edge 36A of the wrapping sheet 36 passing above the first tube former plate 61 and below the second tube former plate 62 shown in phantom.

Figure 30:
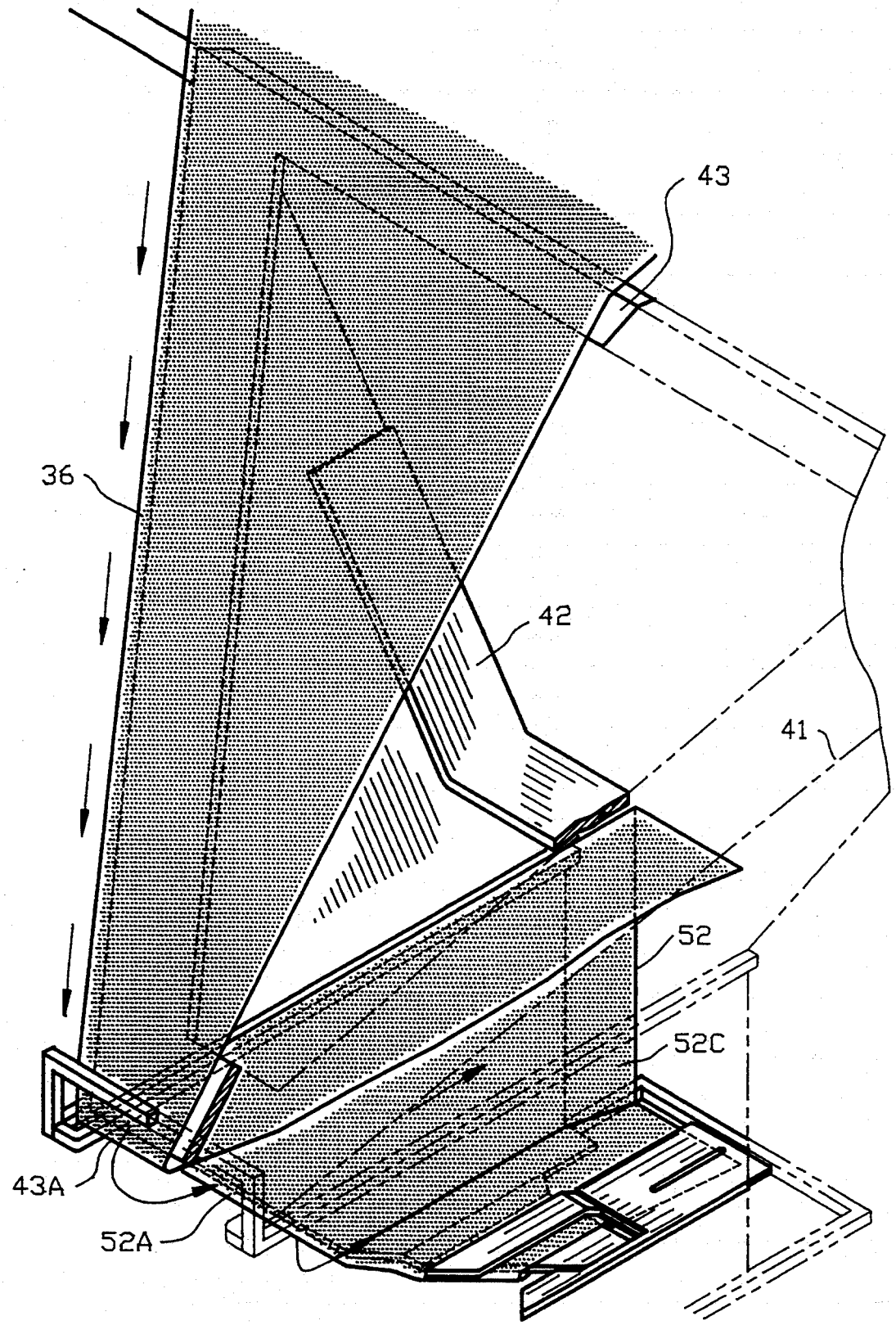
FIG. 30 is a partial isometric view illustrating a second lower tube former wall of the fourth embodiment of the self threading tube former of the present invention.
Figure 31A:
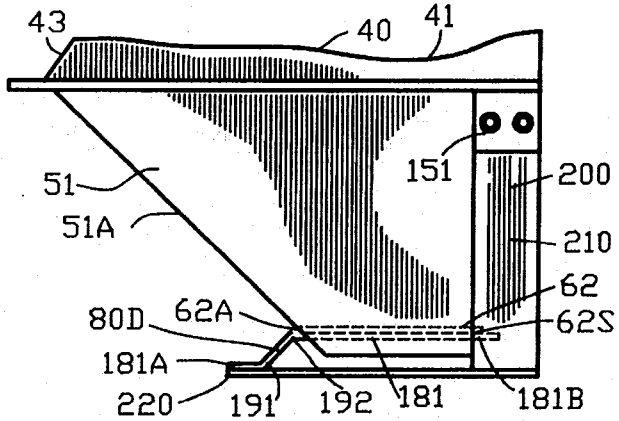
FIG. 31A is a right side view of FIG. 31.

FIG. 30 is a partial isometric view illustrating the second lower tube former wall 52 and the second edge 36B of the wrapping sheet 36 passing above the second tube former plate 62 and into the slot 86.

FIGS. 17–22 and 25–30 illustrate a first and a second rail 141 and 142 secured to the tube former 40 by bolts 151 and 152 proximate to the junction of the first and second lower tube former walls 51 and 52 with the first and second upper tube former walls 41 and 42.

The first and second rails 141 and 142 are spaced from the external surfaces 51B and 52B of the first and second lower tube former walls 51 and 52. The first and second rails 141 and 142 are similarly spaced from the front edges 51A and 52A as well as being spaced from the internal surfaces 51C and 52C of the first and second lower tube former walls 51 and 52.

The first and second rails 141 and 142 direct the wrapping sheet 36 between the first and second rails 141 and 142 and the external surfaces 51B and 52B of the first and second lower tube former walls 51 and 52. In addition, the first and second rails 141 and 142 direct the wrapping sheet 36 between the first and second rails 141 and 142 and the internal surfaces 51C and 52C of the first and second lower tube former walls 51 and 52. The first and second guide rails 141 and 142 provide a more uniform feed and insure the proper positioning of the wrapping sheet relative to the forming tunnel 64.

Figure 31:
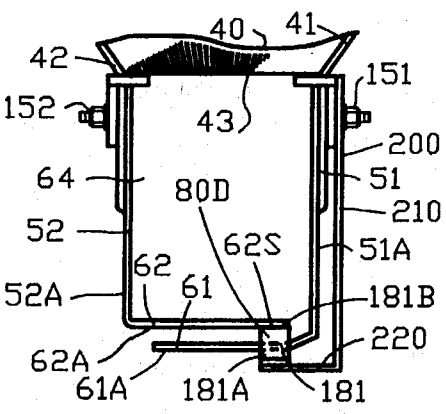
FIG. 31 is a front view of a fifth embodiment of the self threading tube former of the present invention.
Figure 31B:
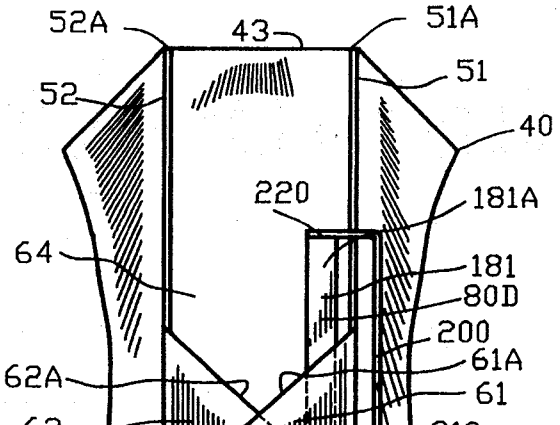
FIG. 31B is a bottom view of FIG. 31.

FIGS. 31—31B illustrate a front view, a right side view and a bottom view, respectively, of a fifth embodiment of the self threader 80D incorporating the present invention. The self threader 80D includes a first guide plate 181 having a front end 181A and a back end 181B. In this embodiment, the first guide plate 181 includes plural bends 191 and 192 interposed between the front and back ends 181A and 181B. The first guide plate 81 is supported by a bracket 200 comprising a base 210 and a longitudinal member 220. The base 210 is secured by screws 151 to the tube former 40 for supporting the longitudinal member 220. The front end 181A of the first guide plate 181 is affixed to the longitudinal member 220 for positioning the back end 181B of the first guide plate 181 located below the second tube former plate 62. Preferably, the first guide plate 181 is made of a resilient metallic material for enabling the back end 181B of the first guide plate 181 to resiliently engage a lower surface 62S of the second tube former plate 62.

Figure 32:
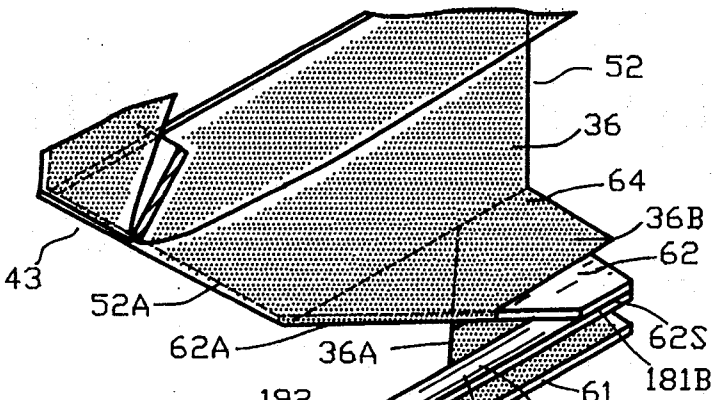
FIG. 32 is a partial isometric view illustrating a second lower tube former wall of the fifth embodiment of the self threading tube former of the present invention.

FIG. 32 is a partial isometric view illustrating the second lower tube former wall 52 with the first edge 36A of the wrapping sheet 36 passing above the first tube former plate 61 and below the second tube former plate 62 and with the second edge 36B of the wrapping sheet 36 passing above the second tube former plate 62. The front edge 181A of the first guide plate 181 extends beyond the front edge 61A of the first tube former plate 61 for directing the first edge 36A of the wrapping sheet 36 below the second tube former plate 62. The first guide plate 181 insures that the first edge 36A of the wrapping sheet 36 is automatically threaded between the first tube former plate 61 and the second tube former plate 62. The first edge 36A overlaps the second edge 36B of the wrapping sheet 36 for forming the wrapping sheet 36 into the tube 66 to receive the package 12 within the tube 66. Furthermore, the first guide plate 181 insures that the first edge 36A of the wrapping sheet 36 will be maintained threaded between the first tube former plate 61 and the second tube former plate 62 during operation of the wrapping machine 10. Although the first guide plate 181 has been shown secure to the tube former 40 through the bracket 200, it should be appreciated by those skilled in the art that the first guide plate 181 may be secured to any suitable surface of the shrink wrapping machine 10.

The present invention overcomes the disadvantages of the prior art wrapping machine and provide a self threader for a wrapping machine for self threading a wrapping sheet within a tube former. The self threader provides a positive means for maintaining the position of the wrapping sheet within the tube former. The self threader is both simple and effective without appreciably raising the cost of the wrapping machine and may be easily adapted to existing wrapping machines.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A self threader for a wrapping machine, the wrapping machine having a tube former including tube former wall means terminating in a first tube former plate and a second tube former plate, the tube former adapted to receive a first edge of a wrapping sheet between the first tube former plate and the second tube former plate and adapted to receive a second edge of the wrapping sheet above the second tube former plate with the first edge of a wrapping sheet overlapping the second edge of a wrapping sheet for forming the wrapping sheet into a tube to receive a product therein, the improvement comprising;

a first guide plate located proximate to the second tube former plate and extending beyond the first tube former plate for directing the first edge of a wrapping sheet between the first tube former plate and the second tube former plate.

2. A self threader for a wrapping machine, as set forth in claim 1, wherein the first tube former plate is disposed in a parallel and spaced apart relationship relative to the second tube former plate.

3. A self threader for a wrapping machine, as set forth in claim 1, including means for pushing product into the tube formed by the wrapping sheet.

4. A self threader for a wrapping machine, as set forth in claim 1, wherein said first guide plate is integrally formed with the second tube former plate.

5. A self threader for a wrapping machine, as set forth in claim 1, wherein the tube former wall means of the tube former includes a first and a second lower tube former wall;

said first and second tube former plates being secured to the first and second lower tube former walls, respectively;

said first guide plate engaging with the second tube former plate and extending adjacent to the first lower tube former wall.

6. A self threader for a wrapping machine, as set forth in claim 1, wherein the tube former wall means of the tube former includes a first and a second upper tube former wall respectively connected to a first and a second lower tube former wall; and the first and second tube former plates being secured substantially perpendicular to the first and second lower tube former walls, respectively.

7. A self threader for a wrapping machine, as set forth in claim 1, wherein the tube former wall means of the tube former includes a first and a second upper tube former wall respectively connected to a first and a second lower tube former wall;

the first and second tube former plates being secured to the first and second lower tube former walls, respectively; and the first and second lower tube former walls having first and second forward edges being angularly orientated for directing the first and second edges of the wrapping sheet toward the first and second tube former plates.

8. A self threader for a wrapping machine, as set forth in claim 1, wherein the tube former wall means of the tube former includes a first and a second upper tube former wall respectively connected to a first and a second lower tube former wall;

the first and second tube former plates being secured to the first and second lower tube former walls, respectively; and a first and a second rail being secured proximate to the junction of the first and second lower tube former walls with the first and second upper tube former walls, respectively for guiding the wrapping sheet.

9. A self threader for a wrapping machine, as set forth in claim 1, wherein the first tube former plate is integrally formed with the first tube former wall and the second tube former plate being integrally formed with the second tube former wall.

10. A self threader for a wrapping machine, as set forth in claim 1, wherein the first tube former plate is disposed substantially perpendicularly to the first tube former wall and the second tube former plate is disposed substantially perpendicularly to the second tube former wall.

11. A self threader for a wrapping machine, as set forth in claim 1, wherein the tube former wall means of the tube former includes a first and a second lower tube former wall connected to the first and second tube former plates with the first and second tube former plates being disposed substantially perpendicularly to the first and second tube former walls, respectively;

a first front edge of the first tube former plate forming an acute angle relative to the first lower tube former wall; and a second front edge of the second tube former plate forming an acute angle relative to the second lower tube former wall.

12. A self threader for a wrapping machine, the wrapping machine having a tube former including tube former wall means terminating in a first tube former plate and a second tube former plate, the tube former adapted to receive a first edge of a wrapping sheet between the first tube former plate and the second tube former plate and adapted to receive a second edge of the wrapping sheet above the second tube former plate with the first edge of a wrapping sheet overlapping the second edge of a wrapping sheet for forming the wrapping sheet into a tube to receive a product therein, the improvement comprising;

a recess defined in a central portion of the first and second tube former plates for enabling the wrapping sheet to rest on the first and second tube former plates proximate said recess with the second edge of the wrapping sheet overlapping the first edge of the wrapping sheet within said recess:

a first guide plate located proximate to the second tube former plate and extending beyond the first tube former plate for directing the first edge of a wrapping sheet between the first tube former plate and the second tube former plate;

a second guide plate located proximate to the second tube former plate and extending beyond the second tube former plate for directing the second edge of the wrapping sheet to overlap the first edge of the wrapping sheet within said recess.

13. A self threader for a wrapping machine, as set forth in claim 12, including an electrostatic generator for electrostatically securing the first edge of the wrapping sheet to the second edge of the wrapping sheet.

14. A self threader for a wrapping machine, as set forth in claim 12, wherein the first tube former plate is disposed in a parallel and spaced apart relationship relative to the second tube former plate.

15. A self threader for a wrapping machine, as set forth in claim 12, including means for pulling the tube formed by the wrapping sheet.

16. A self threader for a wrapping machine, as set forth in claim 12, wherein said first guide plate engages with the second tube former plate; and said second guide plate engages with the second tube former plate.

17. A self threader for a wrapping machine, as set forth in claim 12, wherein the tube former wall means of the tube former includes a first and a second lower tube former wall;

said first and second tube former plates being secured to the first and second lower tube former walls, respectively;

said first guide plate being supported relative to the tube former wall means and extending adjacent to the first lower tube former wall; and said second guide plate being supported relative to the tube former wall and extending adjacent to the second lower tube former wall.

18. A self threader for a wrapping machine, as set forth in claim 12, wherein the tube former wall means of the tube former includes a first and a second upper tube former wall respectively connected to a first and a second lower tube former wall; and the first and second tube former plates being secured substantially perpendicular to the first and second lower tube former walls, respectively.

19. A self threader for a wrapping machine, as set forth in claim 12, wherein the tube former wall means of the tube former includes a first and a second upper tube former wall respectively connected to a first and a second lower tube former wall;

the first and second tube former plates being secured to the first and second lower tube former walls, respectively; and the first and second lower tube former walls having first and second forward edges being angularly orientated for directing the first and second edges of the wrapping sheet toward the first and second tube former plates.

20. A self threader for a wrapping machine, as set forth in claim 12, wherein the tube former wall means of the tube former includes a first and a second upper tube former wall respectively connected to a first and a second lower tube former wall;

the first and second tube former plates being secured to the first and second lower tube former walls, respectively; and a first and a second rail being secured proximate to the junction of the first and second lower tube former walls with the first and second upper tube former walls, respectively for guiding the wrapping sheet.

21. A self threader for a wrapping machine, as set forth in claim 12, wherein the first tube former plate is integrally formed with the first tube former wall and the second tube former plate being integrally formed with the second tube former wall.

22. A self threader for a wrapping machine, as set forth in claim 12, wherein the first tube former plate is disposed substantially perpendicularly to the first tube former wall and the second tube former plate is disposed substantially perpendicularly to the second tube former wall.

23. A self threader for a wrapping machine, as set forth in claim 12, wherein the tube former wall means of the tube former includes a first and a second lower tube former wall connected to the first and second tube former plates with the first and second tube former plates being disposed substantially perpendicularly to the first and second tube former walls, respectively;

a first front edge of the first tube former plate forming an acute angle relative to the first lower tube former wall; and a second front edge of the second tube former plate forming an acute angle relative to the second lower tube former wall.

* * * * *